US007946086B2

(12) United States Patent
Hammer et al.

(10) Patent No.: US 7,946,086 B2
(45) Date of Patent: May 24, 2011

(54) MASONRY BLOCK WALL SYSTEM

(75) Inventors: James Hammer, University Place, WA (US); Todd Ward, Tacoma, WA (US)

(73) Assignee: Westblock Systems, Inc., Salem, OR (US)

( * ) Notice: Subject to any disclaimer, the term of this patent is extended or adjusted under 35 U.S.C. 154(b) by 880 days.

(21) Appl. No.: 11/352,122

(22) Filed: Feb. 10, 2006

(65) Prior Publication Data

US 2006/0201082 A1 Sep. 14, 2006

Related U.S. Application Data

(60) Provisional application No. 60/652,045, filed on Feb. 10, 2005.

(51) Int. Cl.
*E04C 1/00* (2006.01)
*E04C 5/08* (2006.01)
*E04C 2/06* (2006.01)

(52) U.S. Cl. ..... 52/223.5; 52/606; 52/284

(58) Field of Classification Search ..... 52/223.1, 52/223.4, 223.3, 282.2, 284, 582.1, 585.1, 52/592.5, 592.6, 606, 282.1, 286, 223.7
See application file for complete search history.

(56) References Cited

U.S. PATENT DOCUMENTS 3,430,403 A * 3/1969 Muse ..... 52/437
3,936,987 A * 2/1976 Calvin ..... 52/309.1
4,115,980 A * 9/1978 Martel et al. ..... 52/590.2
4,428,174 A * 1/1984 Grady, II ..... 52/745.13
4,651,485 A 3/1987 Osborne
4,703,602 A * 11/1987 Pardo ..... 52/564
4,726,567 A * 2/1988 Greenberg ..... 256/19
4,821,483 A * 4/1989 Adams ..... 52/747.12
4,865,781 A * 9/1989 Jennings ..... 264/35
4,896,999 A * 1/1990 Ruckstuhl ..... 405/286
5,233,810 A * 8/1993 Jennings ..... 52/745.19
5,501,057 A * 3/1996 Dawson ..... 52/761
5,623,797 A 4/1997 Gravier et al.
5,685,119 A * 11/1997 Zschoppe ..... 52/592.5
5,688,078 A * 11/1997 Hammer ..... 405/286
5,707,184 A * 1/1998 Anderson et al. ..... 405/286
5,794,921 A 8/1998 Greenberg (Continued)

OTHER PUBLICATIONS

International Preliminary Report on Patentability, mailed Nov. 1, 2007, for corresponding International Application No. PCT/US2006/004727.

(Continued)

*Primary Examiner* — Khoi Tran
*Assistant Examiner* — Jason Holloway
(74) *Attorney, Agent, or Firm* — Klarquist Sparkman, LLP

(57) ABSTRACT

A system for constructing masonry block walls having spaced-apart pilasters and panels supported by and extending between the pilasters. In certain embodiments, the pilasters are constructed from stacks of pilaster blocks which are secured together using at least one vertical, post-tensioned reinforcing member, without the use of grout to connect the reinforcing members to the pilaster blocks. The pilasters are constructed from at least two laterally spaced-apart stacks of pilaster blocks positioned on opposite sides of the wall. The panels are constructed from courses of panel blocks, and do not require the use of mortar to connect adjacent blocks. The pilasters provide an arrangement in which a panel can supported in an upright position by virtue of one end portion being positioned between two stacks of blocks of a first pilaster and the opposite end portion of the panel being positioned between two stacks of blocks of a second pilaster.

22 Claims, 19 Drawing Sheets

U.S. PATENT DOCUMENTS

| | | | | |
|---|---|---|---|---|
| 5,913,790 | A * | 6/1999 | Dawson | 52/609 |
| 6,189,282 | B1 * | 2/2001 | VanderWerf | 52/582.1 |
| 6,282,859 | B1 * | 9/2001 | Van Der Heijden | 52/585.1 |
| 6,431,797 | B2 | 8/2002 | Greenberg | |
| 6,543,969 | B1 | 4/2003 | Adam | |
| 6,584,750 | B1 * | 7/2003 | Hanna | 52/745.1 |
| 6,632,048 | B2 * | 10/2003 | Greenberg | 405/284 |
| 6,691,471 | B2 * | 2/2004 | Price | 52/169.12 |
| 6,735,913 | B2 * | 5/2004 | Sanders et al. | 52/284 |
| 6,758,020 | B2 * | 7/2004 | Cerrato | 52/606 |
| 6,821,058 | B1 * | 11/2004 | Dawson | 405/284 |
| 7,168,892 | B1 * | 1/2007 | MacDonald et al. | 405/284 |
| 7,373,760 | B2 * | 5/2008 | Tokuno et al. | 52/223.7 |
| 7,418,804 | B2 * | 9/2008 | Tokuno et al. | 52/223.7 |
| 2002/0043038 | A1 * | 4/2002 | Cerrato | 52/604 |
| 2003/0074856 | A1 * | 4/2003 | Hammer | 52/604 |
| 2003/0233798 | A1 * | 12/2003 | Berkey et al. | 52/223.7 |
| 2004/0020144 | A1 | 2/2004 | Sanders et al. | |
| 2005/0108973 | A1 * | 5/2005 | Hammer et al. | 52/596 |
| 2005/0252147 | A1 * | 11/2005 | MacDonald et al. | 52/606 |
| 2005/0284077 | A1 * | 12/2005 | Spratlen et al. | 52/606 |
| 2007/0245673 | A1 * | 10/2007 | Cerrato | 52/607 |

OTHER PUBLICATIONS

Westblock Systems, Inc., BarrierStone technical manual, published prior to Feb. 2005 (22 pages).

* cited by examiner

Wind Pressure Table

| Wind Speed mph | Wind pressure psf | | Exposure | | |
|---|---|---|---|---|---|
| | | | B | C | D |
| | | | 1.00 | 1.21 | 1.47 |
| 85 | 10.00 | | 10.00 | 12.14 | 14.71 |
| 90 | 11.10 | | 11.10 | 13.48 | 16.33 |
| 100 | 13.70 | | 13.70 | 16.64 | 20.16 |
| 110 | 14.50 | | 14.50 | 17.61 | 21.34 |
| 120 | 17.20 | | 17.20 | 20.89 | 25.31 |
| 130 | 20.20 | | 20.20 | 24.53 | 29.72 |
| 140 | 23.50 | | 23.50 | 28.54 | 34.58 |
| 150 | 26.90 | | 26.90 | 32.66 | 39.58 |
| 170 | 34.60 | | 34.60 | 42.01 | 50.91 |

Notes

1.) The engineer of record, licensed in the state where the wall is to be located, shall verify the local jurisdiction's wind and seismic design requirements.

2.) Wind design values will govern in most wind and seismic regions. Due to the seismic requirements for non-building structures in high seismic regions having a short period acceleration ($S_s$) greater than 1.5g and a 1-second acceleration ($S_1$) greater than 0.5g the seismic loading to the walls may exceed the wind loading. See note 1.

3.) Wall sections have been designed using the 2003 IBC.

4.) For wind load design $K_{zt}$ has been assumed to be 1.0. Engineer of record to verify $K_{zt}$ for wall locations.

200

FIG. 19

Five (5) fence blocks at 1'-6" each, equals 7'-6" + 9" pilaster space = 8'-3" center to center of pilasters.

Fence Span 8.25 ft
Lateral Load 10.00 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. Inches | Rod Force lbs | Rod Dia. inches | Rod Force lbs | | | |
| 4.00 | 1/2 | 2.25 | 1.38 | 3,200 | ½ | 1,600 | 1/2 | 800 | 2,900 | 700 | 2.00 |
| 4.67 | 1/2 | 2.25 | 1.25 | 3,600 | ½ | 2,200 | 1/2 | 1,100 | 3,400 | 900 | 2.25 |
| 5.33 | 1/2 | 2.25 | 1.25 | 4,100 | ½ | 2,900 | 1/2 | 1,500 | 3,700 | 1,200 | 2.25 |
| 6.00 | 1/2 | 2.25 | 1.13 | 4,600 | ½ | 3,600 | 1/2 | 1,800 | 4,200 | 1,500 | 2.50 |
| 6.67 | 1/2 | 2.25 | 1.13 | 5,000 | ½ | 4,500 | 1/2 | 2,300 | 4,600 | 1,900 | 2.50 |
| 7.33 | 1/2 | 2.25 | 1.00 | 5,500 | 5/8 | 5,400 | 1/2 | 2,700 | 5,100 | 2,300 | 2.75 |
| 8.00 | 1/2 | 2.25 | 1.00 | 5,900 | 5/8 | 6,400 | 1/2 | 3,200 | 5,700 | 2,700 | 3.00 |

202

Six (6) fence blocks at 1'-6" each, equals 9'-0" + 9" pilaster space = 9'-9" center to center of pilasters.

Fence Span 9.75 ft
Lateral Load 10.00 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. Inches | Rod Force lbs | Rod Dia. inches | Rod Force lbs | | | |
| 4.00 | 1/2 | 2.25 | 1.38 | 4,600 | ½ | 1,900 | 1/2 | 1,000 | 3,200 | 800 | 2.00 |
| 4.67 | 1/2 | 2.25 | 1.25 | 5,200 | ½ | 2,600 | 1/2 | 1,300 | 3,700 | 1,100 | 2.25 |
| 5.33 | 1/2 | 2.25 | 1.25 | 5,900 | ½ | 3,400 | 1/2 | 1,700 | 4,300 | 1,400 | 2.50 |
| 6.00 | 1/2 | 2.25 | 1.13 | 6,500 | ½ | 4,300 | 1/2 | 2,200 | 4,700 | 1,800 | 2.50 |
| 6.67 | 5/8 | 2.19 | 1.00 | 7,100 | 5/8 | 5,300 | 1/2 | 2,700 | 5,300 | 2,200 | 2.75 |
| 7.33 | 5/8 | 2.19 | 1.00 | 7,700 | 5/8 | 6,300 | 1/2 | 3,200 | 5,900 | 2,700 | 3.00 |
| 8.00 | 5/8 | 2.19 | 1.00 | 8,400 | 5/8 | 7,500 | 1/2 | 3,800 | 6,300 | 3,200 | 3.00 |

204

FIG. 20A

Seven (7) fence blocks at 1'-6" each, equals 10'-6" + 9" pilaster space = 11'-3" center to center of pilasters.

Fence Span 11.25 ft

Lateral Load 10.00 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. inches | Rod Force lbs | Rod Dia. inches | Rod Force lbs | | | |
| 4.00 | 1/2 | 2.25 | 1.38 | 6,200 | 1/2 | 2,200 | 1/2 | 1,100 | 3,700 | 900 | 2.25 |
| 4.67 | 5/8 | 2.19 | 1.13 | 7,000 | 1/2 | 3,000 | 1/2 | 1,500 | 4,100 | 1,300 | 2.25 |
| 5.33 | 5/8 | 2.19 | 1.13 | 7,800 | 1/2 | 3,900 | 1/2 | 2,000 | 4,700 | 1,600 | 2.50 |
| 6.00 | 5/8 | 2.19 | 1.00 | 8,700 | 1/2 | 4,900 | 1/2 | 2,500 | 5,400 | 2,100 | 2.75 |
| 6.67 | 5/8 | 2.19 | 1.00 | 9,600 | 5/8 | 6,100 | 1/2 | 3,100 | 6,000 | 2,600 | 3.00 |
| 7.33 | 5/8 | 2.19 | .88 | 10,500 | 5/8 | 7,300 | 1/2 | 3,700 | 6,500 | 3,100 | 3.00 |
| 8.00 | 3/4 | 2.13 | .88 | 11,100 | 3/4 | 8,700 | 1/2 | 4,400 | 7,100 | 3,600 | 3.25 |

206

Notes:

1) Typical blocks used are the Westblock 5"x18" fence block with a 1"x2-1/2" slot and the 5"x16" pilaster block.
2) All blocks shall be manufactured per ASTM C-90 with F'c=3,000 psi.
3) Rods shall be per ASTM A36 with Fy = 36 ksi.
4) Minimum square footing sizes are given for an allowable soil bearing pressure of 1,500 PSF.
5) All design has been accomplished using the 2003 IBC.
6) Lateral load should be as calculated by a licensed engineer using the 2003 IBC Wind and/or Seismic provisions.
7) Pressures in Tables are based on the Alternative Basic Load Combinations per Section 6105.3.2 of the 2003 IBC.
8) Pilaster Loads (dead load) and Overturning moments in the table are given to allow an alternate foundation design.
9) Overturning and foundation calculations assume: 12" thick concrete footing, 10 PLF Fence Cap and a 90 lb Pilaster Cap.

FIG. 20B

Five (5) fence blocks at 1'-6" each, equals 7'-6" + 9" pilaster space = 8'-3" center to center of pilasters.

Fence Span 8.25 ft
Lateral Load 13.33 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. inches | Rod Force lbs | Rod Dia. inches | Rod Force lbs | | | |
| 4.00 | 1/2 | 2.25 | 1.38 | 3,400 | 1/2 | 2,200 | 1/2 | 1,100 | 2,900 | 900 | 2.00 |
| 4.67 | 1/2 | 2.25 | 1.25 | 3,900 | 1/2 | 2,900 | 1/2 | 1,500 | 3,400 | 1,200 | 2.25 |
| 5.33 | 1/2 | 2.25 | 1.25 | 4,400 | 1/2 | 3,800 | 1/2 | 1,900 | 3,900 | 1,600 | 2.50 |
| 6.00 | 1/2 | 2.25 | 1.25 | 4,900 | 1/2 | 4,800 | 1/2 | 2,400 | 4,200 | 2,000 | 2.50 |
| 6.67 | 1/2 | 2.25 | 1.13 | 5,400 | 5/8 | 5,900 | 1/2 | 3,000 | 4,800 | 2,500 | 2.75 |
| 7.33 | 1/2 | 2.25 | 1.13 | 5,900 | 5/8 | 7,100 | 1/2 | 3,600 | 5,300 | 3,000 | 3.00 |
| 8.00 | 1/2 | 2.25 | 1.13 | 6,400 | 3/4 | 8,500 | 1/2 | 4,300 | 5,900 | 3,600 | 3.25 |

208

Six (6) fence blocks at 1'-6" each, equals 9'-0" + 9" pilaster space = 9'-9" center to center of pilasters.

Fence Span 9.75 ft
Lateral Load 13.33 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. inches | Rod Force lbs | Rod Dia. inches | Rod Force lbs | | | |
| 4.00 | 1/2 | 2.25 | 1.38 | 4,900 | 1/2 | 2,500 | 1/2 | 1,300 | 3,300 | 1,100 | 2.25 |
| 4.67 | 1/2 | 2.25 | 1.38 | 5,600 | 1/2 | 3,500 | 1/2 | 1,800 | 3,900 | 1,500 | 2.50 |
| 5.33 | 1/2 | 2.25 | 1.25 | 6,400 | 1/2 | 4,500 | 1/2 | 2,300 | 4,300 | 1,900 | 2.50 |
| 6.00 | 5/8 | 2.19 | 1.13 | 6,900 | 5/8 | 5,700 | 1/2 | 2,900 | 4,900 | 2,400 | 2.75 |
| 6.67 | 5/8 | 2.19 | 1.13 | 7,600 | 5/8 | 7,000 | 1/2 | 3,500 | 5,500 | 2,900 | 3.00 |
| 7.33 | 5/8 | 2.19 | 1.00 | 8,300 | 3/4 | 8,400 | 1/2 | 4,200 | 5,900 | 3,500 | 3.00 |
| 8.00 | 5/8 | 2.19 | 1.00 | 9,000 | 3/4 | 10,000 | 5/8 | 5,000 | 6,500 | 4,200 | 3.25 |

210

FIG. 20C

Seven (7) fence blocks at 1'-6" each, equals 10'-6" + 9" pilaster space = 11'-3" center to center of pilasters.

Fence Span 11.25 ft
Lateral Load 13.33 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. inches | Rod Force Lbs | Rod Dia. inches | Rod Force lbs | | | |
| 4.00 | 1/2 | 2.25 | 1.38 | 6,500 | 1/2 | 2,900 | 1/2 | 1,500 | 3,700 | 1,200 | 2.25 |
| 4.67 | 5/8 | 2.19 | 1.25 | 7,500 | 1/2 | 4,000 | 1/2 | 2,000 | 4,300 | 1,700 | 2.50 |
| 5.33 | 5/8 | 2.19 | 1.25 | 8,500 | 5/8 | 5,200 | 1/2 | 2,600 | 4,900 | 2,200 | 2.75 |
| 6.00 | 5/8 | 2.19 | 1.13 | 9,400 | 5/8 | 6,500 | 1/2 | 3,300 | 5,600 | 2,700 | 3.00 |
| 6.67 | 5/8 | 2.19 | 1.13 | 10,400 | 3/4 | 8,100 | 1/2 | 4,100 | 6,000 | 3,400 | 3.00 |
| 7.33 | 3/4 | 2.13 | 1.00 | 11,100 | 3/4 | 9,700 | 1/2 | 4,900 | 6,700 | 4,100 | 3.25 |
| 8.00 | masonry stresses exceeded for F'm=3,000 psi | | | | | | | | | | |

212

FIG. 20D

5" wide Fence Block with 1" x 2-1/2" slot

Five (5) fence blocks at 1'-6 each, equals 7'-6" + 9" pilaster space = 8'-3" center to center of pilasters.

Fence Span 8.25 ft
Lateral Load 16.67 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. inches | Rod Force lbs | Rod Dia. inches | Rod Force lbs | | | |
| 4.00 | 1/2 | 2.25 | 1.50 | 3,700 | 1/2 | 2,700 | 1/2 | 1,400 | 3,000 | 1,100 | 2.25 |
| 4.67 | 1/2 | 2.25 | 1.38 | 4,200 | 1/2 | 3,600 | 1/2 | 1,800 | 3,400 | 1,500 | 2.25 |
| 5.33 | 1/2 | 2.25 | 1.38 | 4,800 | 1/2 | 4,700 | 1/2 | 2,400 | 4,100 | 2,000 | 2.75 |
| 6.00 | 1/2 | 2.25 | 1.38 | 5,300 | 5/8 | 6,000 | 1/2 | 3,000 | 4,600 | 2,500 | 3.00 |
| 6.67 | 1/2 | 2.25 | 1.25 | 5,800 | 5/8 | 7,400 | 1/2 | 3,700 | 5,200 | 3,100 | 3.25 |
| 7.33 | 1/2 | 2.25 | 1.25 | 6,200 | 3/4 | 8,900 | 1/2 | 4,500 | 5,600 | 3,700 | 3.25 |
| 8.00 | 5/8 | 2.19 | 1.13 | 6,800 | 3/4 | 10,600 | 5/8 | 5,300 | 6,400 | 4,400 | 3.75 |

214

Six (6) fence blocks at 1'-6" each, equals 9'-0" + 9" pilaster space = 9'-9" center to center of pilasters.

Fence Span 9.75 ft
Lateral Load 16.67 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. inches | Rod Force lbs | Rod Dia. inches | Rod Force lbs | | | |
| 4.00 | 1/2 | 2.25 | 1.50 | 5,300 | 1/2 | 3,200 | 1/2 | 1,600 | 3,300 | 1,300 | 2.25 |
| 4.67 | 1/2 | 2.25 | 1.38 | 6,100 | 1/2 | 4,300 | 1/2 | 2,200 | 3,900 | 1,800 | 2.50 |
| 5.33 | 5/8 | 2.19 | 1.25 | 6,700 | 5/8 | 5,600 | 1/2 | 2,800 | 4,500 | 2,400 | 2.75 |
| 6.00 | 5/8 | 2.19 | 1.25 | 7,500 | 5/8 | 7,100 | 1/2 | 3,600 | 5,100 | 3,000 | 3.00 |
| 6.67 | 5/8 | 2.19 | 1.25 | 8,200 | 3/4 | 8,700 | 1/2 | 4,400 | 5,700 | 3,700 | 3.25 |
| 7.33 | 5/8 | 2.19 | 1.13 | 9,000 | 3/4 | 10,500 | 5/8 | 5,300 | 6,400 | 4,400 | 3.50 |
| 8.00 | 5/8 | 2.19 | 1.13 | 9,700 | n/a | 12,500 | 5/8 | 6,300 | 7,100 | 5,200 | 3.75 |

216

FIG. 21A

Seven (7) fence blocks at 1'-6" each, equals 10'-6" + 9" pilaster space = 11'-3" center to center of pilasters.

Fence Span 11.25 ft
Lateral Load 16.67 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. inches | Rod Force lbs | Rod Dia. Inches | Rod Force lbs | | | |
| 4.00 | 5/8 | 2.19 | 1.38 | 7,000 | 1/2 | 3,600 | 1/2 | 1,800 | 3,800 | 1,500 | 2.50 |
| 4.67 | 5/8 | 2.19 | 1.38 | 8,100 | 1/2 | 5,000 | 1/2 | 2,500 | 4,300 | 2,100 | 2.50 |
| 5.33 | 5/8 | 2.19 | 1.25 | 9,100 | 5/8 | 6,400 | 1/2 | 3,200 | 4,900 | 2,700 | 2.75 |
| 6.00 | 5/8 | 2.19 | 1.25 | 10,100 | 3/4 | 8,100 | 1/2 | 4,100 | 5,800 | 3,400 | 3.25 |
| 6.67 | 3/4 | 2.13 | 1.13 | 11,000 | 3/4 | 10,100 | 5/8 | 5,100 | 6,500 | 4,200 | 3.50 |
| 7.33 | 3/4 | 2.13 | 1.13 | 12,000 | n/a | 12,100 | 5/8 | 6,100 | 7,200 | 5,100 | 3.75 |

218

Five (5) fence blocks at 1'-6" each, equals 7'-6" + 9" pilaster space = 8'-3" center to center of pilasters.

Fence Span 8.25 ft
Lateral Load 20.00 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. inches | Rod Force lbs | Rod Dia. Inches | Rod Force lbs | | | |
| 4.00 | 1/2 | 2.25 | 1.50 | 3,900 | 1/2 | 3,200 | 1/2 | 1,600 | 3,000 | 1,400 | 2.25 |
| 4.67 | 1/2 | 2.25 | 1.50 | 4,500 | 1/2 | 4,400 | 1/2 | 2,200 | 3,700 | 1,800 | 2.75 |

220

FIG. 21B

Six (6) fence blocks at 1'-6" each, equals 9'-0" + 9" pilaster space = 9'-9" center to center of pilasters.

Fence Span 9.75 ft

Lateral Load 20.00 PSF

| Fence Height ft | Fence | | | | Single Rod Pilaster | | Double Rod Pilaster | | Pil & Ftg Weight lbs | Overturning Moment ft-lbs | Minimum footing required |
|---|---|---|---|---|---|---|---|---|---|---|---|
| | Rod Dia. inches | Bot Rod Location | Top Rod Location | Rod Fence lbs | Rod Dia. inches | Rod Force lbs | Rod Dia. inches | Rod Force Lbs | | | |
| 4.00 | 1/2 | 2.25 | 1.50 | 5,600 | 1/2 | 3,800 | 1/2 | 1,900 | 3,500 | 1,600 | 2.50 |
| 4.67 | 1/2 | 2.25 | 1.50 | 6,500 | 5/8 | 5,200 | 1/2 | 2,600 | 4,100 | 2,200 | 2.75 |

222

Notes:

1) Typical blocks used are the Westblock 5"x18" fence block with a 1"x 2-1/2" slot and the 5"x 16" pilaster block.
2) All blocks shall be manufactured per ASTM C-90 with F'c=3,000 psi.
3) Rods shall be per ASTM A36 with Fy = 36 ksi.
4) Minimum square footing sizes are given for an allowable soil bearing pressure of 1,500 PSF.
5) All design has been accomplished using the 2003 IBC.
6) Lateral load should be as calculated by a licensed engineer using the 2003 IBC Wind and/or Seismic provisions.
7) Pressures in Tables are based on the Alternative Basic Load Combinations per Section 6105.3.2 of the 2003 IBC.
8) Pilaster Loads (dead load) and Overturning moments in the table are given to allow an alternate foundation design.
9) Overturning and foundation calculations assume: 12" thick concrete footing, 10 PLF Fence Cap and a 90 lb Pilaster Cap.

FIG. 21C

MASONRY BLOCK WALL SYSTEM

CROSS-REFERENCE TO RELATED APPLICATION

The present application claims the benefit of U.S. Provisional Application No. 60/652,045, filed Feb. 10, 2005.

FIELD

The present disclosure concerns embodiments of a masonry block wall system, and in particular, a free-standing wall, or fence, constructed of masonry blocks preferably without the use of mortar or grout.

BACKGROUND

The construction of a free-standing wall from masonry blocks using known techniques is time consuming and requires the expensive skills of a mason. Typically, such walls require frequent vertically extending reinforcing bars anchored in a concrete footer extending the length of the wall and horizontal reinforcing bars extending through selected courses of the wall. The vertical reinforcing bars are typically extended upward through voids in the masonry blocks. The voids surrounding the vertical and horizontal reinforcing bars typically are filled with grout to connect the reinforcing bars to the blocks in the wall.

The expense of conventional materials and the time required for building these structures using conventional methods limit the use of these otherwise durable masonry block systems. Unlike wood fences, masonry block wall systems resist weathering and provide a permanent structure that requires little, if any, maintenance. Block walls also provide excellent security, privacy, and/or sound suppression. However, block walls require structural integrity to withstand wind or other exterior forces. The fulfillment of these structural requirements is thought to necessitate the use of current building materials and techniques. Elimination of skill intensive building techniques and materials requiring special skill, and streamlining the process for building free-standing block walls would result in substantial savings in time, labor costs, and material costs for building such walls.

SUMMARY

The present disclosure concerns a system for constructing masonry block walls having spaced-apart pilasters and panels supported by and extending between the pilasters. The system does not require substantial excavation, concrete grade beams or skilled labor. In certain embodiments, the pilasters are constructed from stacks of pilaster blocks which are secured together using at least one vertical, post-tensioned reinforcing member, without the use of grout to connect the reinforcing members to the pilaster blocks. The pilasters preferably are supported on respective footings or piers spaced at intervals along the wall, therefore eliminating the requirement of a continuous footing extending between the pilasters. The panels are constructed from courses of panel blocks, and do not require the use of mortar to connect adjacent blocks. Instead, block-connecting elements (e.g., a plastic connecting pin or plug) can be used to connect vertically adjacent blocks in the courses, with selected one or more courses being reinforced with horizontally extending, post-tensioned reinforcing members. Again, grout is not needed to connect the reinforcing members to the panel blocks. The masonry block wall system therefore greatly simplifies and expedites the construction of a wall because substantially less concrete is need as compared to prior systems and the expensive skills of a mason are not required.

The pilasters in particular embodiments are constructed from at least two laterally spaced-apart stacks of pilaster blocks positioned on opposite sides of the wall. The spacing between the stacks of pilaster blocks is sufficient to receive an end portion of a panel. The pilasters therefore provide an arrangement in which a panel can be supported in an upright position by virtue of one end portion being positioned between two stacks of blocks of a first pilaster and the opposite end portion of the panel being positioned between two stacks of blocks of a second pilaster, preferably without any mechanical fasteners for securing or connecting the panels directly to the pilasters. Advantageously, the pilasters support the panel, but yet allow for a certain degree of panel movement relative to the stacks of pilaster blocks to enhance the stability of the wall.

The pilaster arrangement further simplifies wall construction due to the existence of a large degree of dimensional forgiveness between the pilasters and the panels. More specifically, the void in each pilaster that receives the end portion of one or more panels is large enough to accommodate variations in the length of a panel or the spacing between the pilasters that may occur during the construction of the wall. Consequently, a high degree of precision with regard to pilaster spacing or panel size is not required in the construction of a wall, as is required in prior systems.

In one representative embodiment, a masonry block wall structure comprises at least first and second footings formed in the ground and spaced along the wall structure. First and second pilasters are supported on the first and second footings, respectively, with each pilaster comprising at least a first stack of pilaster blocks and at least a second stack of pilaster blocks positioned on opposite sides of the wall structure from each other. At least one vertical post-tensioned reinforcing member extends upwardly through and reinforces each pilaster. The wall structure further includes at least one panel comprising a plurality of courses of panel blocks, the courses being without any mortar or grout between adjacent panel blocks. The panel has first and second end portions, the first end portion being positioned between and abutting the first and second stacks of pilaster blocks of the first pilaster and the second end portion being positioned between and abutting the first and second stacks of pilaster blocks of the second pilaster such that the panel is supported by and extends between the first and second pilasters.

In another representative embodiment, a masonry block wall structure comprises first and second pilasters located at spaced apart locations along the wall structure. Each pilaster comprises at least a first stack of pilaster blocks and at least a second stack of pilaster blocks positioned on opposite sides of the wall structure from each other and at least one vertical post-tensioned reinforcing member extending upwardly through and reinforcing the pilaster. The wall structure further includes at least one panel comprising a plurality of courses of panel blocks, the panel having first and second end portions. The first end portion is positioned between the first and second stacks of pilaster blocks of the first pilaster and the second end portion is positioned between the first and second stacks of pilaster blocks of the second pilaster such that the panel is supported by and extends between the first and second pilasters.

In yet another representative embodiment, a method for forming a masonry block wall structure comprises forming at least first and second footings at spaced apart locations in the ground. First and second pilasters are formed on the first and second footings, respectively, with each pilaster comprising at least a first stack of pilaster blocks and at least a second stack of pilaster blocks formed at a location spaced from the first stack, and a vertical reinforcing member extending the height of the pilaster. A panel is constructed between the pilasters by forming at least a first lower course of panel blocks extending between the pilasters and at least a second upper course of panel blocks overlying the first course and extending between the pilasters. Each course of panel blocks has a first end and a second end, wherein portions of the panel blocks at the first ends of the courses are positioned between and abut against the first and second stacks of pilaster blocks of the first pilaster and portions of the panel blocks at the second ends of the courses are positioned between and abut against the first and second stacks of pilaster blocks of the second pilaster such that the panel is supported by and extends between the first and second pilasters. The method further includes tensioning the reinforcing members to reinforce the pilasters.

The foregoing and other features and advantages of the invention will become more apparent from the following detailed description of several embodiments, which proceeds with reference to the accompanying figures.

BRIEF DESCRIPTION OF THE DRAWINGS

FIG. 19 shows an exemplary wind pressure table that can be used to determine the anticipated wind pressure on a wall to be constructed.

FIGS. 20 and 21 show exemplary design tables that can be used to determine certain design criteria for constructing a wall.

DETAILED DESCRIPTION

As used herein, the singular forms "a," "an," and "the" refer to one or more than one, unless the context clearly dictates otherwise.

As used herein, the term "includes" means "comprises." For example, a device that includes or comprises A and B contains A and B but may optionally contain C or other components other than A and B. A device that includes or comprises A or B may contain A or B or A and B, and optionally one or more other components such as C.

Figure 1:
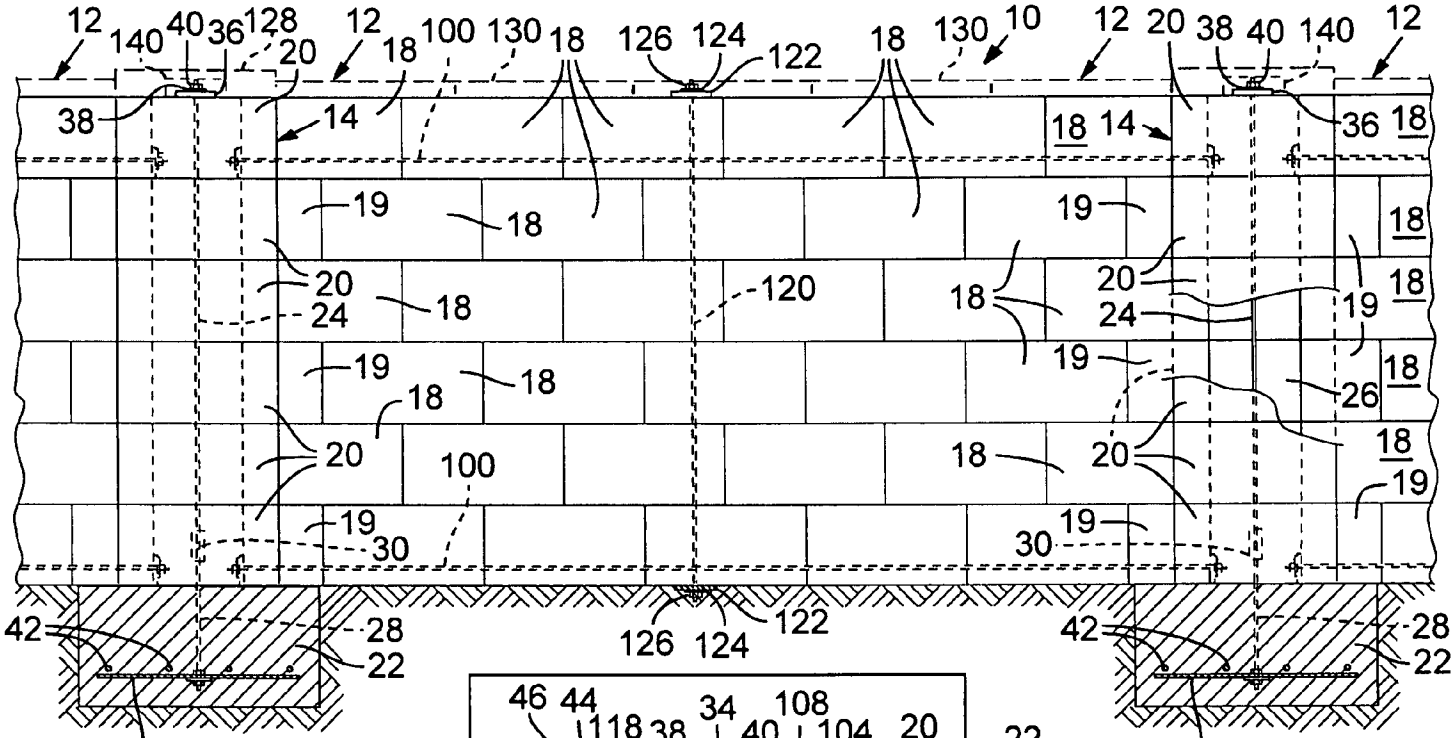
FIG. 1 is a front elevational view of a free-standing wall constructed from a plurality of masonry blocks, according to one embodiment.
Figure 2:
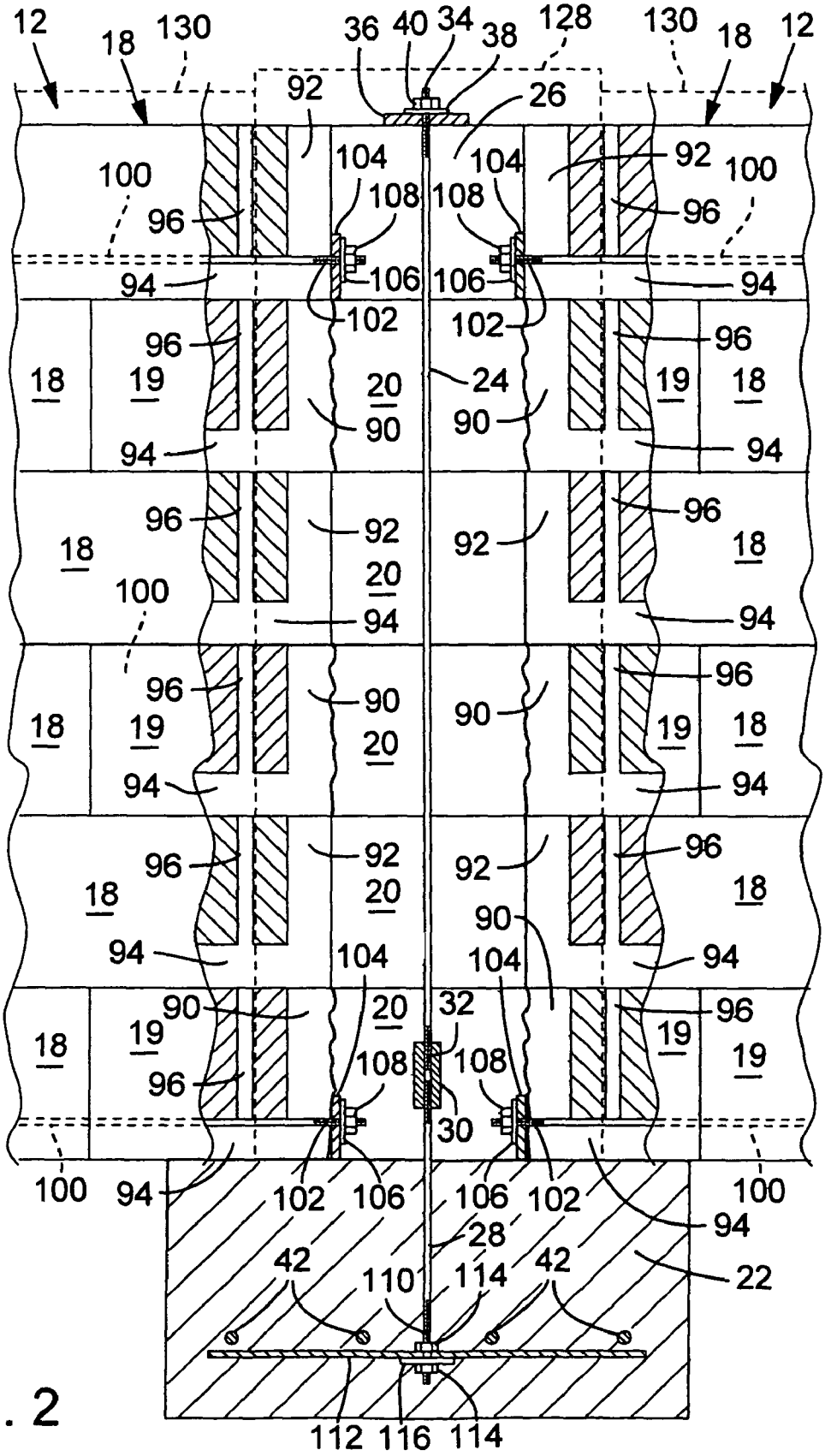
FIG. 2 is an enlarged, fragmentary front elevational view the wall shown in FIG. 1.

Referring first to FIGS. 1 and 2, there is shown a free-standing wall structure 10 (e.g., a fence), according to one embodiment, comprising one or more panels 12 supported between pilasters. The pilasters can be a field pilaster 14 positioned at the ends of two adjacent panels 12 positioned end-to-end in a 180-degree relationship with respect to each other in one side of the wall structure (as shown in FIG. 1), a corner pilaster 16 (FIG. 14) positioned at a 90-corner of the wall structure, or a pilaster 78 (FIG. 15) positioned at a T-shaped juncture of the wall structure. The panels 12 are constructed from a plurality of panel blocks 18 placed in rows, or courses, of such blocks. The end blocks (the blocks at the end of each course) of every other course comprise "half-blocks" 19, which are ½ the length of panel blocks 18, so as to form a "running bond" pattern of blocks in the panels 12, as described in detail below. The pilasters 14, 16 are constructed from a plurality of pilaster blocks 20, as further described below.

Desirably, capping blocks 128 are disposed on top of each pilaster 14, 16 and a course of capping blocks 130 is formed on top of the uppermost course of panel blocks in each panel 12. Capping blocks 128 have voids, or openings, 140 formed in the bottom surfaces of the blocks to receive plates 36, washers 38, nuts 40, and the upper portions of reinforcing members 24 (described below) extending above the uppermost pilaster blocks 20. Capping blocks 128 and 130 also can be formed with horizontal openings (not shown) extending completely through the blocks in a direction longitudinally of the wall to allow utility conduits to be placed on top of the uppermost courses of panel blocks 18 and pilaster blocks 20 along the length of the wall.

A plurality of spaced apart footings, or piers, 22 are formed in the ground to support the pilasters 14, 16 (although only field pilasters 14 are shown in FIG. 1). The footings 22 can be reinforced with re-bars 42 as shown or other reinforcement devices. The ends of the panels 12 desirably are supported on the footings to increase the overall load on the footings, and therefore better resist tipping forces.

Figure 6:
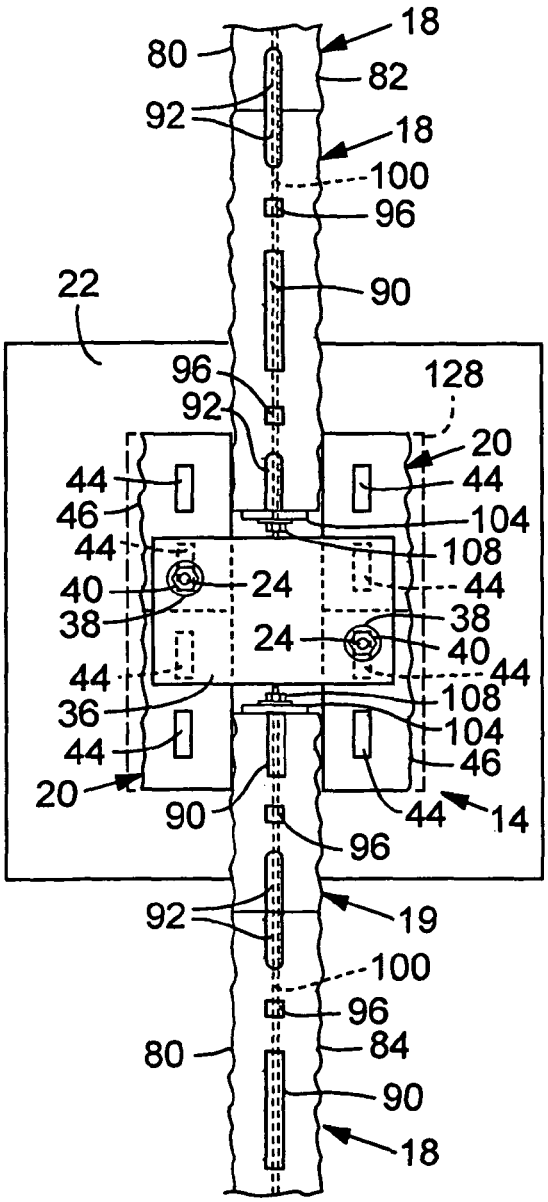
FIG. 6 is an enlarged, fragmentary top plan view of a wall similar to FIG. 3, but having a pilaster construction incorporating two vertical reinforcing members.
Figure 7:
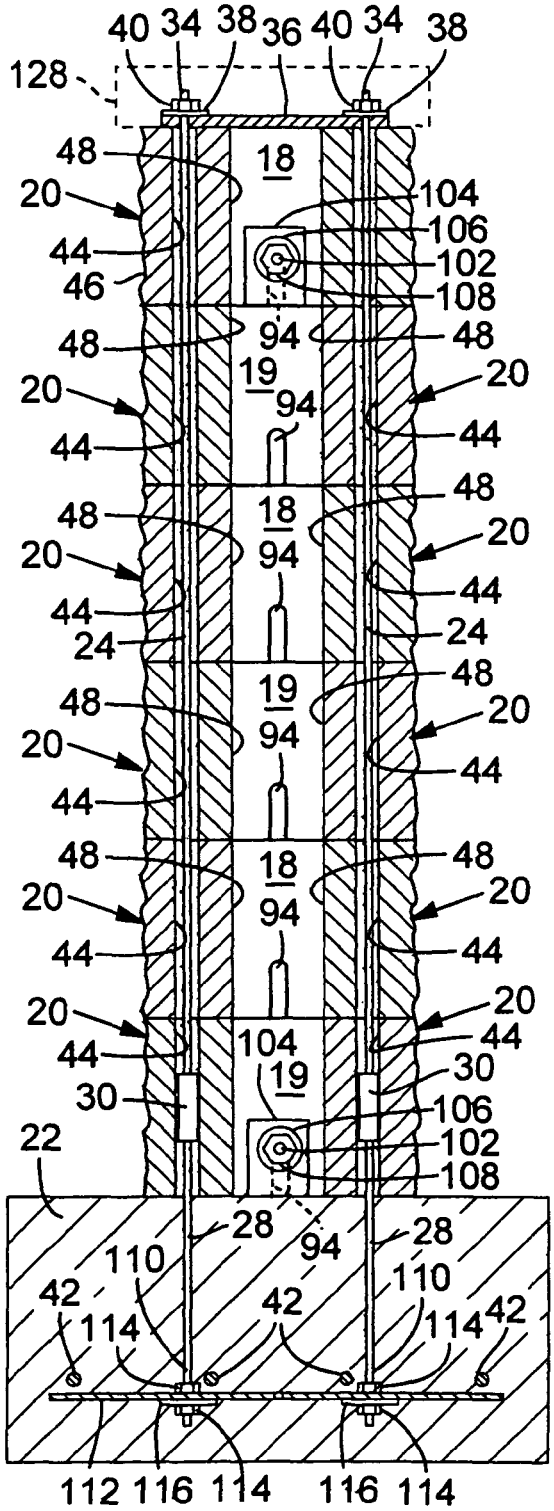
FIG. 7 is a vertical cross-sectional view of the pilaster shown in FIG. 6.

The pilasters 14, 16 desirably are reinforced with one or more post-tensioned vertical reinforcing members 24 secured to the footings 22 and extending upwardly through the pilasters. Typically, each pilaster is provided with one or two vertical reinforcing members, depending on the particular application. In the embodiment shown in FIGS. 1-3, each pilaster 14 has one vertical reinforcing member 24, which preferably is centrally located within the respective pilaster. FIGS. 6 and 7 (described in greater detail below) illustrate a pilaster construction using two vertical reinforcing members, according to one embodiment.

The reinforcing members 24 typically are steel rods or bars, but can be any elongated member that can be post-tensioned to reinforce the pilasters. In particular embodiments, for example, the reinforcing members 24 comprise steel rods having a diameter of 0.50", 0.625", or 0.75", although smaller or larger diameter rods also can be used. In alternative embodiments, the reinforcing members 24 can be flexible cables (e.g., steel cables) or the like that can be placed in tension to reinforce the pilasters.

Figure 3:
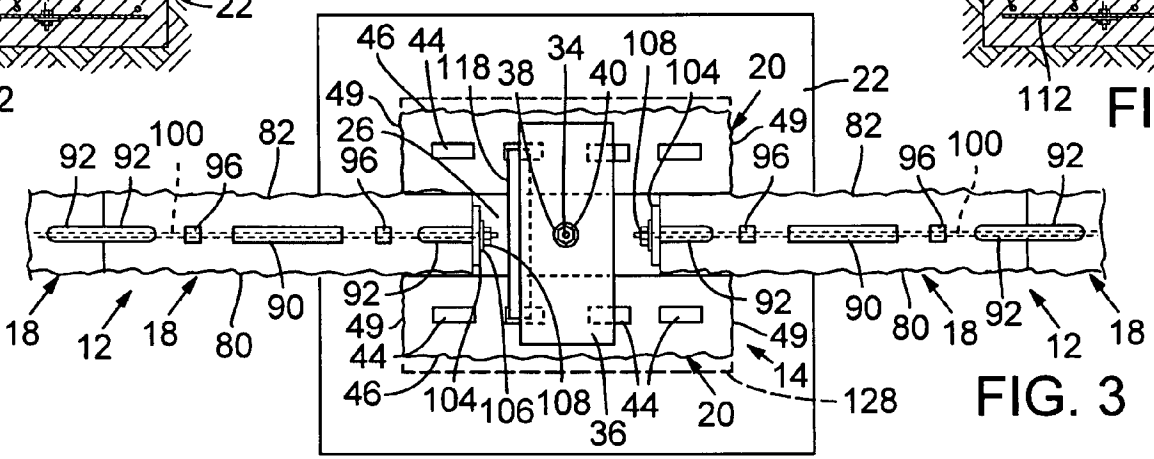
FIG. 3 is an enlarged, fragmentary top plan view of the wall shown in FIG. 1.
Figure 4:
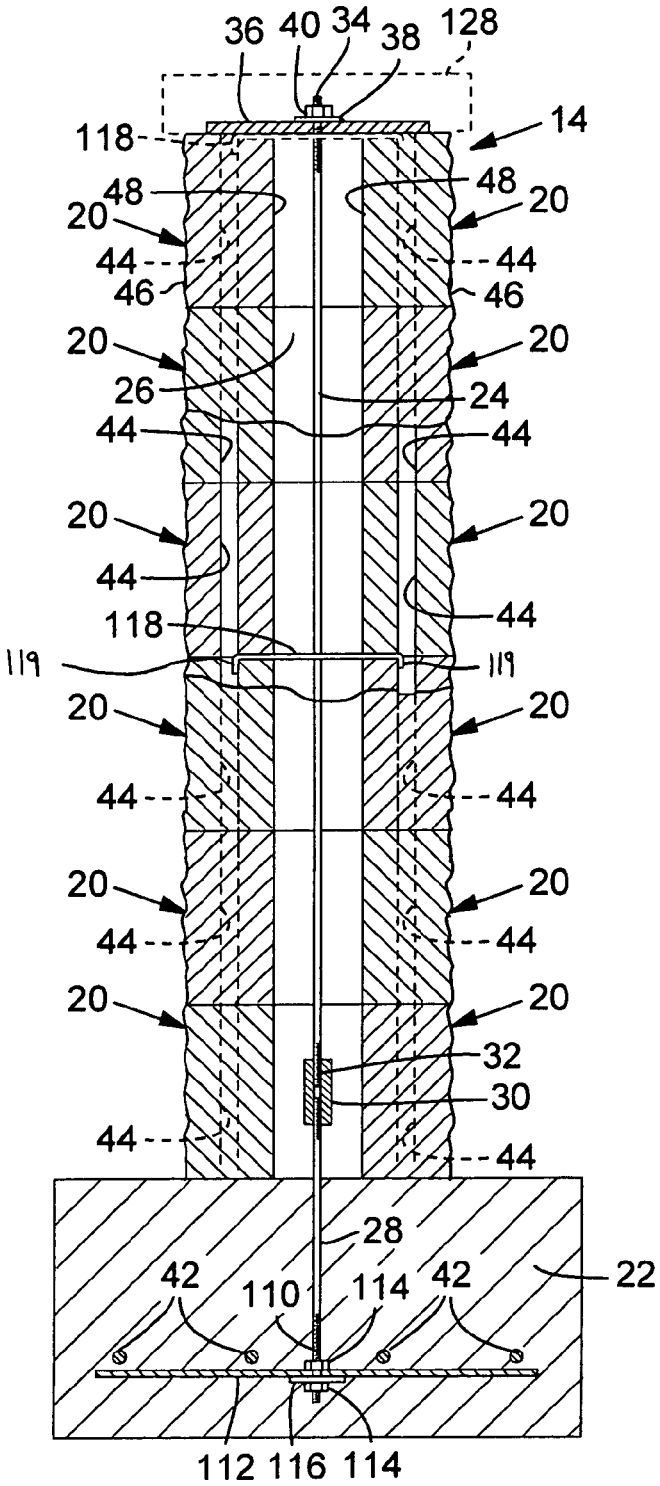
FIG. 4 is a vertical cross-sectional view of a pilaster of the wall shown in FIG. 1.

As shown in FIGS. 3 and 4, each pilaster 14 is formed from two laterally spaced-apart stacks of pilaster blocks 20 positioned on opposite sides of the wall structure 10 and partially overlapping adjacent end portions of two panels 12 to form a substantially closed void 26 between the adjacent ends of the panels and extending the height of the pilaster. When one vertical reinforcing member 24 is used to reinforce the pilaster 14 (as depicted in FIGS. 1-3), the reinforcing member 24 desirably is centrally located within the void 26.

The lower end portions of the reinforcing members 24 can be secured to the footings 22 using any suitable techniques or mechanisms. In the embodiment shown in FIGS. 1-3, for example, each pilaster is provided with a vertically upright steel rod 28 embedded in the respective footing 22 and extending upwardly into the void 26. As best shown in FIG. 2, each rod 28 has a threaded lower end portion 110 that extends through a horizontal plate 112 embedded in the footing 22. The rod 28 can be secured to the plate 112 using a washer 116 and nuts 114 tightened onto the threaded outer surface of the lower end portion 110 on opposite sides of the plate 112. The rod 28 has a threaded upper end portion secured to an internally threaded coupling member 30. Coupling member 30 has an internally threaded bore sized to receive a threaded lower end portion 32 of the reinforcing member 24 and the threaded upper end portion of the rod 28.

In another embodiment, "J-hooks" (not shown) can be used instead of rods 28. In the latter embodiment, the J-hooks have their lower end portions embedded in the footings and their upper end portions connected to threaded coupling members 30 that are secured to the reinforcing members 24. In yet another embodiment, the reinforcing members 24 are secured to the footings 22 by inserting the lower end portions of the reinforcing members 24 into the footings 22 before the concrete sets. The reinforcing members can have curved or J-shaped lower end portions when the lower end portions are embedded directly in the footings.

As best shown in FIG. 2, each reinforcing member 24 has a threaded upper end portion 34 extending through a rigid plate 36 and a washer 38, with a nut 40 tightened onto the end portion 34 above the washer 38. As depicted in FIG. 3, the length of the plate 36 is greater than the width of the void 26, and therefore spans the width of the void and partially overlaps the two top pilaster blocks 20 in the pilaster 14. Tightening the nut 40 against the plate 36 tensions the reinforcing member 24 and applies a corresponding compressive force against the pilaster blocks 20, thereby reinforcing the pilaster. Optionally, a gasket material (e.g., latex cement) can be applied to the upper surfaces of the top pilaster blocks 20 to provide a bearing surface for the plate 36.

In certain embodiments, washers 38 can comprise direct tension indicating (DTI) washers, such as commercially available from Applied Bolting Technology Products, Inc. (Bellows Falls, Vt.). When a reinforcing member is tensioned to the desired, predetermined tension, the force applied to the washer causes the washer to emit a colored liquid as a visual indicator that the reinforcing member 24 has been properly tensioned.

Figure 9A:
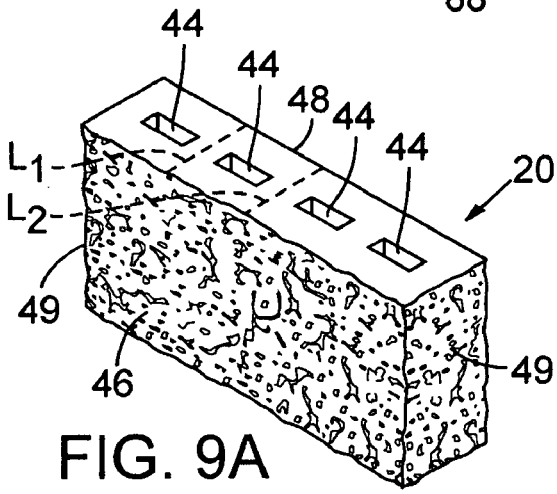
FIG. 9A is a perspective view of a pilaster block, according to one embodiment, used to form pilasters in a wall.
Figure 9B:
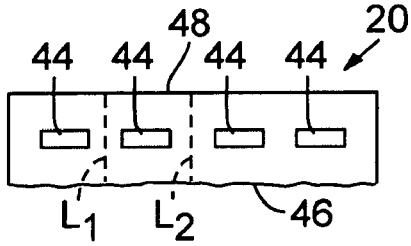
FIG. 9B is a bottom plan view of the pilaster block shown in FIG. 9A.
Figure 9C:
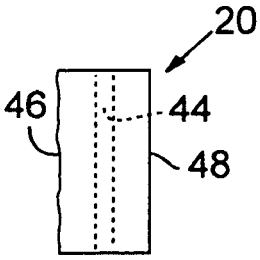
FIG. 9C is an end elevational view of the pilaster block shown in FIG. 9A.

FIGS. 9A-9C are enlarged views of a pilaster block 20. The pilaster block 20 is generally rectangular and includes a plurality of openings, or slots, 44 extending the height of the block. Hence, the slots 44 open to the upper and lower surfaces of the block 20. The slots 44 are equally spaced from each other lengthwise of the block along a line equally spaced between the front and back surfaces 46, 48, respectively, of the block. The openings 44 are sized to receive a block-connecting element (e.g., the block-connecting element 50 shown in FIG. 10 or the block-connecting element 52 shown in FIG. 11) for connecting vertically adjacent blocks in a pilaster, as further described below. The configuration of the pilaster block is not limited to that shown in FIGS. 9A-9C. Accordingly, the pilaster block 20 can be any of various other geometric shapes, such as a trapezoid (FIG. 17), square, a rectangle, a parallelogram (FIG. 18), a diamond, or various combinations thereof. Also, in other embodiments, the block 20 can be formed without any openings 44.

As shown in FIG. 9A, the front surface 46 and the end surfaces 49 of the pilaster block 20 desirably are provided with a "split-face" texture resembling natural stone that can be accomplished by suitable splitting techniques. Alternatively, the front surface 46 and the end surfaces 49 of the block can be provided with a roughened surface resembling natural stone using the mold apparatus described in U.S. Patent Application Publication No. 2003-0164574, entitled "Apparatus and Methods for Making a Masonry Block with a Roughened Surface," which is incorporated herein by reference.

When constructing the pilaster 14, either block-connecting elements 50 (FIG. 10) or block-connecting elements 52 (FIG. 11) can be used to facilitate alignment of the pilaster blocks 20 as they are stacked on top of each other. The block-connecting elements 50, 52 also function to connect vertically adjacent blocks to better resist shear forces on the wall structure 10.

Figure 10:
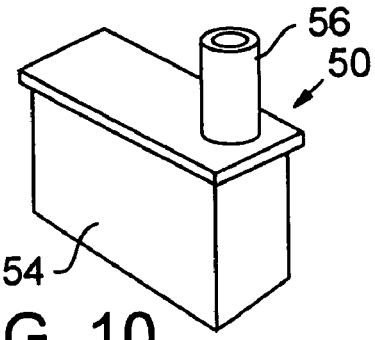
FIG. 10 is a perspective view of a block-connecting element, according to one embodiment, used for connecting vertically adjacent blocks.
Figure 12:
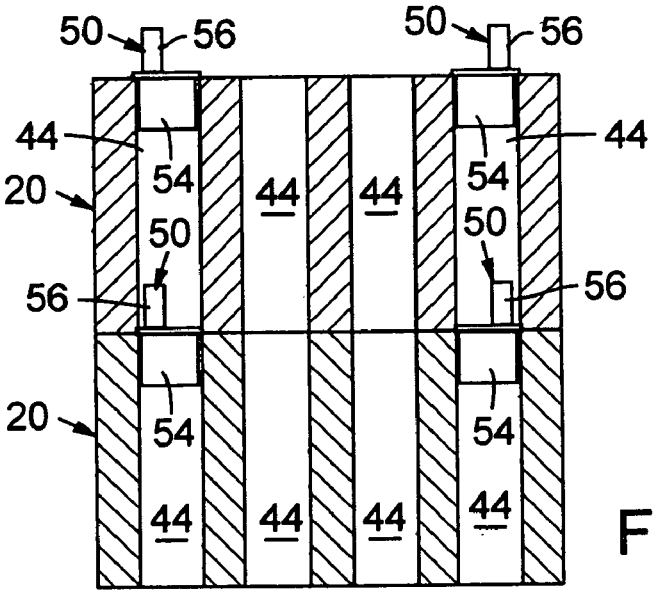
FIG. 12 is a cross-sectional view showing the use of the block-connecting elements of FIG. 10 in the construction of a pilaster.

As shown in FIG. 10, the block-connecting element 50 comprises an enlarged, generally rectangular lower portion 54 and a generally cylindrical, pin-shaped upper portion 56. The block-connecting element 50 can be referred to an alignment "plug" because of its enlarged lower body portion. Referring to FIG. 12, when block-connecting elements 50 are used in the construction of a pilaster 14, the lower portion 54 of an element 50 is inserted into an opening 44 of a pilaster block 20 through the upper surface of that block. The upper portion 56 of the block-connecting element is inserted into a corresponding opening 44 of an overlying pilaster block 20 as it is stacked on top of the previously laid block. In the illustrated example, two block-connecting elements 50 are used to interconnect a pair of vertically adjacent pilaster blocks 20. However, greater or fewer number of block-connecting elements can be used, depending on the particular application. Block-connecting elements 50 typically are placed in the outermost openings 44 in the blocks (the openings 44 closest to the block ends) as shown in FIG. 12, in the event vertical reinforcing members 24 are placed in the inner openings 44 (FIGS. 6 and 7).

Figure 11:
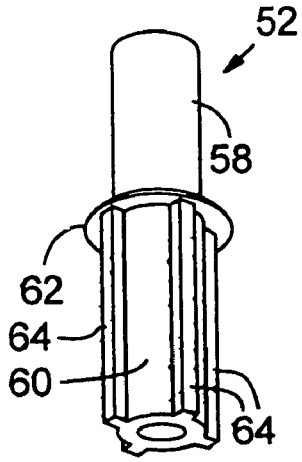
FIG. 11 is a perspective view of a block-connecting element having a generally pin-shaped construction.

Block-connecting elements 52 (FIG. 11) can be used in lieu of or in addition to block-connecting elements 50 in forming a pilaster. As shown in FIG. 11, block-connecting element 52 comprises a generally pin-shaped structure (and therefore can be referred to as an "alignment pin"). Block-connecting element 52 includes a generally cylindrical upper portion 58, a generally cylindrical lower portion 60, an annular apron 62 separating the upper and lower portions, and a plurality of angularly spaced ribs 64 extending the length of the lower portion 60. When block-connecting elements 52 are used in the construction of a pilaster, the lower portion 60 of a block-connecting element is inserted into an opening 44 of a pilaster block 20 positioned in one of stacks forming the pilaster 14. The block-connecting element 52 is secured in place by a frictional engagement between the ribs 64 and the inner surface of the opening 44. The upper portion 58 is inserted into a corresponding opening 44 of an overlying pilaster block 20 as it is stacked on top of the previously laid block.

In certain embodiments, as shown in FIG. 4, one or more clips or connectors 118 can be used in the construction of a pilaster to interconnect pilaster blocks 20 on opposite sides of the void 26 to further stabilize the pilaster. Each clip 118 spans the width of the void and has two downwardly projecting leg portions 119, each of which is received in a respective opening 44 in a pilaster block 20. The top surfaces of the pilaster blocks 20 can be formed with small depressions or recesses to receive the clips 118. The clips 118 can be formed from, for example, strips of 16-gage metal. Typically, a clip 118 is installed about every two feet along the height of the pilaster, although the actual number and spacing of the clips 118 will depend on the particular installation.

FIGS. 6 and 7 illustrate the construction of a pilaster 14 using two post-tensioned, vertical reinforcing members 24. The pilaster 14 shown in FIGS. 6 and 7 is constructed in the same manner as the pilaster shown in FIGS. 2 and 3, except that two reinforcing members 24 are used, each of which extends vertically through openings 44 in a stack of pilaster blocks 20. The reinforcing members 24 desirably are offset from each other in the direction of the wall in the manner shown in FIG. 6, rather than directly across from each other in the wall, to better distribute the compression force of the rigid plate 36 to the stacks of pilaster blocks 20. If desired, additional reinforcing members 24 can be installed in the other openings 44 in the stacks of pilaster blocks or in the void 26 between the stacks of pilaster blocks.

Figure 14:
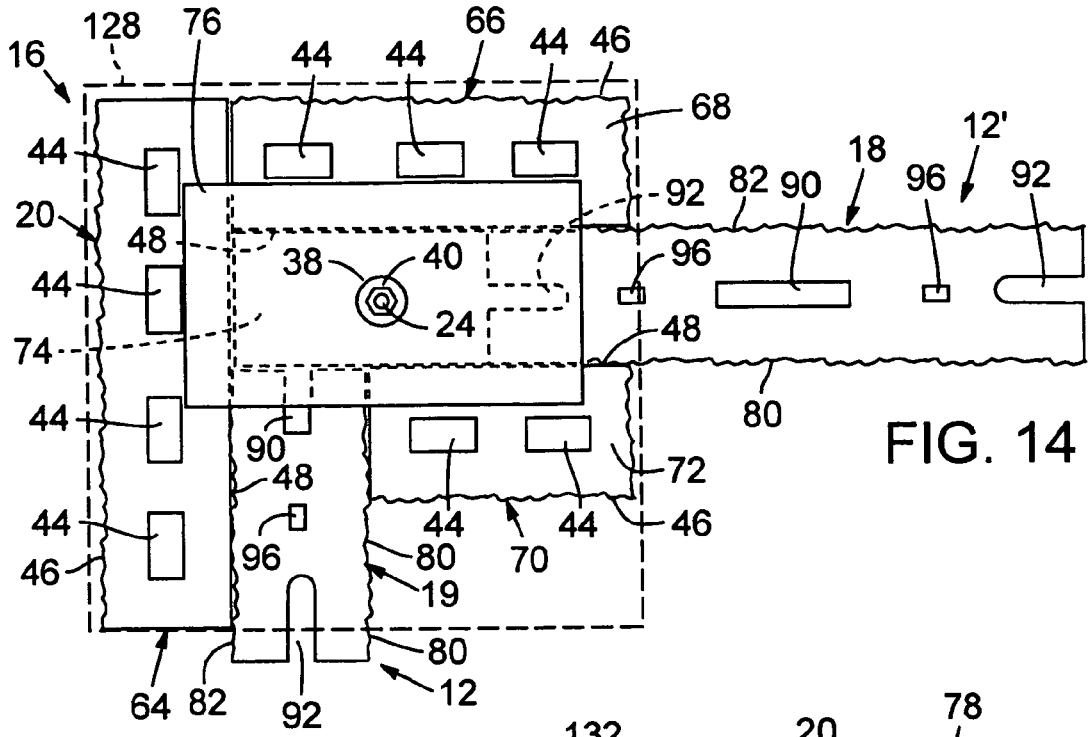
FIG. 14 is a top plan view of a corner pilaster used to form a 90-degree corner in a wall.

FIG. 14 illustrates one possible approach for constructing a corner pilaster 16 that forms a 90-degree corner in a wall structure. As shown, a first stack 64 of pilaster blocks 20 is formed on a footing 22 as previously described so as to form one side of the pilaster 16. A second stack 66 of pilaster blocks 68 is formed at a 90-degree angle with respect to the first stack 64. A third stack 70 of pilaster blocks 72 is formed at a 90-degree angle with respect to the first stack 64 and is spaced from the first stack 64 the width of a panel 12 and from the second stack 66 the width of another panel 12' extending at a 90-degree angle with respect to panel 12. The end portion of panel 12 is disposed between the first stack 64 and the third stack 70 and the end portion of panel 12' is disposed between the second stack 66 and the third stack 70 so as to form a closed void 74 extending the height of the pilaster 16. The length of pilaster blocks 68 forming the second stack 66 is ¾ the length of pilaster blocks 20 while the length of pilaster blocks 72 forming the third stack is ½ the length of pilaster blocks 20. In this manner, the pilaster 16 forms a horizontal footprint that fits within the square footprint of a capping block 128 placed on top of the pilaster, as depicted in FIG. 14.

A vertical reinforcing member 24 is installed in the void 74 and tensioned in the manner described above to reinforce the pilaster 16. The reinforcing member extends through a rigid plate 76 that at least partially overlaps the uppermost pilaster blocks in stacks 64, 66, 70 and the uppermost panel blocks 18 at the ends of panels 12, 12'. While only one vertical reinforcing member 24 is shown in the illustrated embodiment, multiple reinforcing members 24 can be used in the construction of the pilaster 16.

Figure 9D:
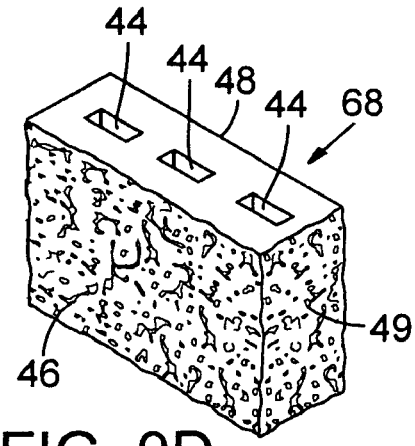
FIG. 9D is a perspective view of another pilaster block, which has the same overall shape of the pilaster block of FIG. 9A but is about ¾ the length of the block of FIG. 9A.
Figure 9E:
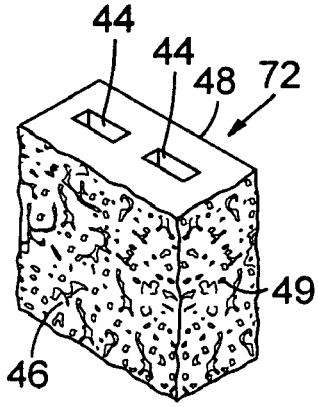
FIG. 9E is a perspective view of another pilaster block, which has the same overall shape of the pilaster block of FIG. 9A but is about ½ the length of the block of FIG. 9A.

Pilaster block 68 (best shown in FIG. 9D) can be formed by splitting or cutting a pilaster block 20 along a line $L_1$ (FIGS. 9A and 9B) spaced ¼ the length of the block 20 from one end of the block (i.e., at a location between one of the outer openings 44 and the adjacent inner opening 44). Pilaster block 72 (best shown in FIG. 9E) can be formed by splitting or cutting a pilaster block along a line $L_2$ (FIGS. 9A and 9B) spaced equidistant between the opposite ends of the block 20 (i.e., between the two inner openings 44). Advantageously, pilaster blocks of all the same size can be provided for forming a corner pilaster to reduce manufacturing costs, with blocks 68, 72 being formed at the job site using conventional splitting techniques.

Figure 15:
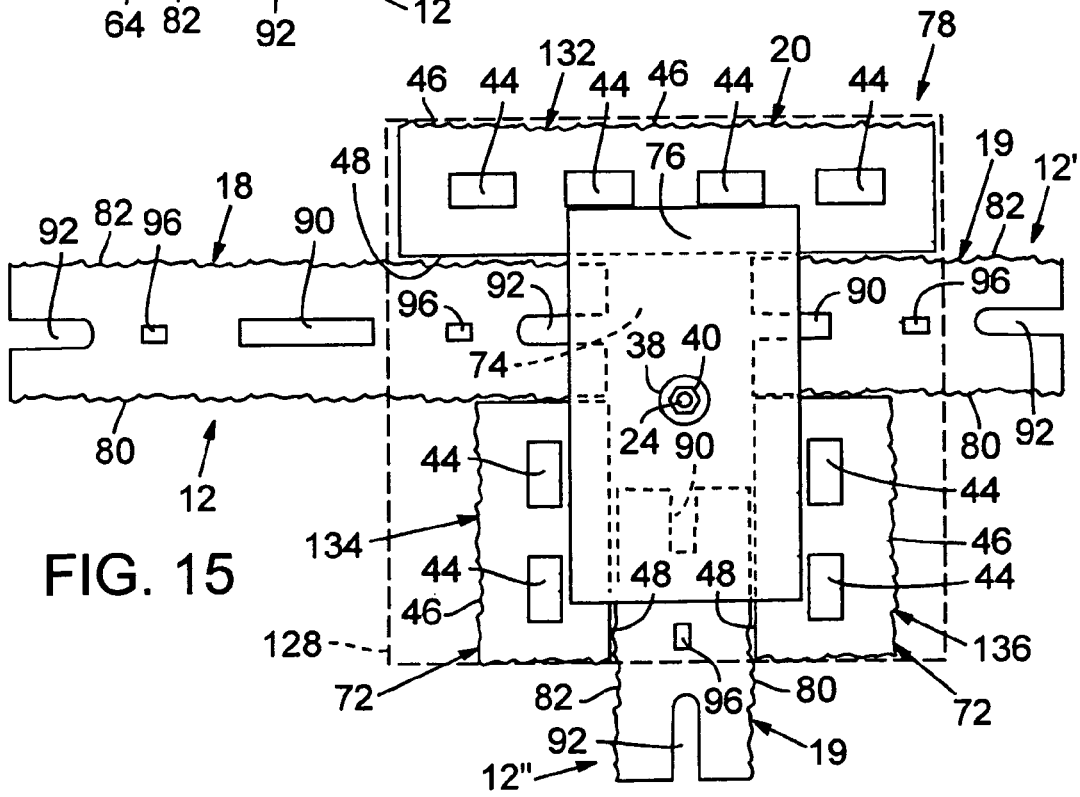
FIG. 15 is a top plan view of a pilaster used to form a T-shaped intersection of wall panels in a wall.

FIG. 15 illustrates a pilaster 78 used to form a T-shaped junction of panels 12, 12', and 12" in a wall. The pilaster 78 comprises a first stack 132 of pilaster blocks 20 on one side of the wall surface defined by panels 12 and 12'. Second and third stacks 134, 136, respectively, of pilaster blocks 72 are formed in a parallel relationship with respect to each other and are spaced from each other the width of panel 12". The second and third stacks 134, 136 are oriented at a 90-degree angle with respect to the first stack 132 and are spaced therefrom the width of panels 12 and 12'. The end portion of panel 12 is disposed between the first stack 132 and the second stack 134, the end portion of panel 12' is disposed between the first stack 132 and the third stack 136, and the end portion of panel 12" is disposed between the second stack and the third stack to form a substantially closed void extending the height of the pilaster 78. One or more post-tensioned, vertical reinforcing members 24 can be used to reinforce the pilaster.

Figure 8A:
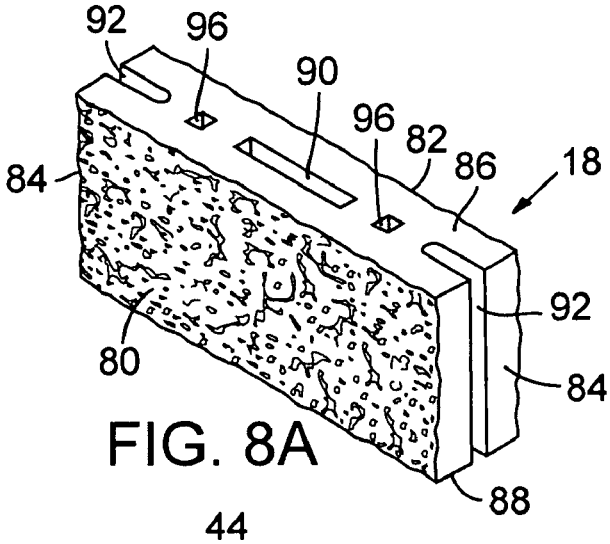
FIG. 8A is a perspective view of a panel block, according to one embodiment, used to form panels in a wall.
Figure 8B:
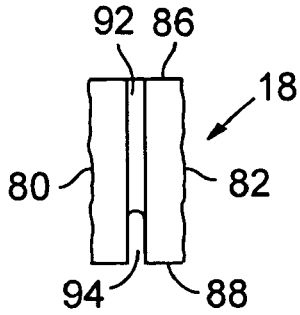
FIG. 8B is an end elevational view of the panel block shown in FIG. 8A.
Figure 8C:
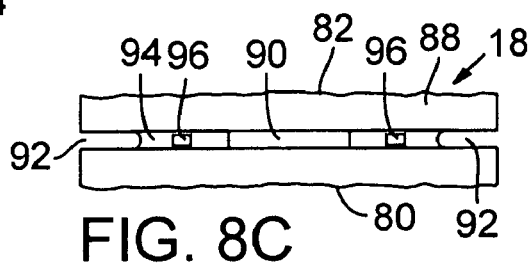
FIG. 8C is a bottom plan view of the panel block shown in FIG. 8A.

As best shown in FIGS. 8A-8C, the panel block 18 in the illustrated configuration is generally rectangular and comprises opposed, generally parallel first and second faces 80, 82, respectively, sides 84 extending between respective ends of the first and second faces 80, 82, an upper surface 86 and a parallel lower surface 88. In other embodiments, however, the panel block 18 can be any of various other geometric shapes, such as a square, a trapezoid, a parallelogram, a diamond, or various combinations thereof.

As best shown in FIG. 8B, the panel block 18 includes a horizontally extending opening, or slot, 94 formed in the lower surface 88 and extending the block length (measured between the sides 84). The slot 94 is sized to receive a post-tensioned horizontal reinforcing member 100 for reinforcing a course of panel blocks 18, as further described below.

The first and second faces 80, 82 (which are exposed in the front and back surface of a panel 12) desirably are provided with a roughened surface texture (as shown in FIG. 8A), for example, using conventional splitting techniques or the technique disclosed in U.S. Patent Application Publication No. 2003-0164574. The illustrated panel block 18 also is formed with a central core, or opening, 90 desirably extending from the slot 94 to the upper surface 86 of the block. The panel block 18 also can be formed with two "half cores" or openings 92 formed in the sides 84 and extending the height of the block. As shown in FIG. 3, when the panel blocks 18 are placed side-by-side in courses, the adjacent sides 84 of two panel blocks abut each other so that the openings 92 of two adjacent blocks form a closed void. The block 18 also can be formed with optional openings 96 on opposite sides of the central core 90 and extending from the slot 94 to the upper surface 86 of the block. Openings 90 and 92 are sized to receive a block-connecting element 50 (FIG. 10) for connecting vertically adjacent blocks. Openings 96 are sized to receive a block-connecting element 52 (FIG. 11) for connecting vertically adjacent blocks.

Figure 25A:
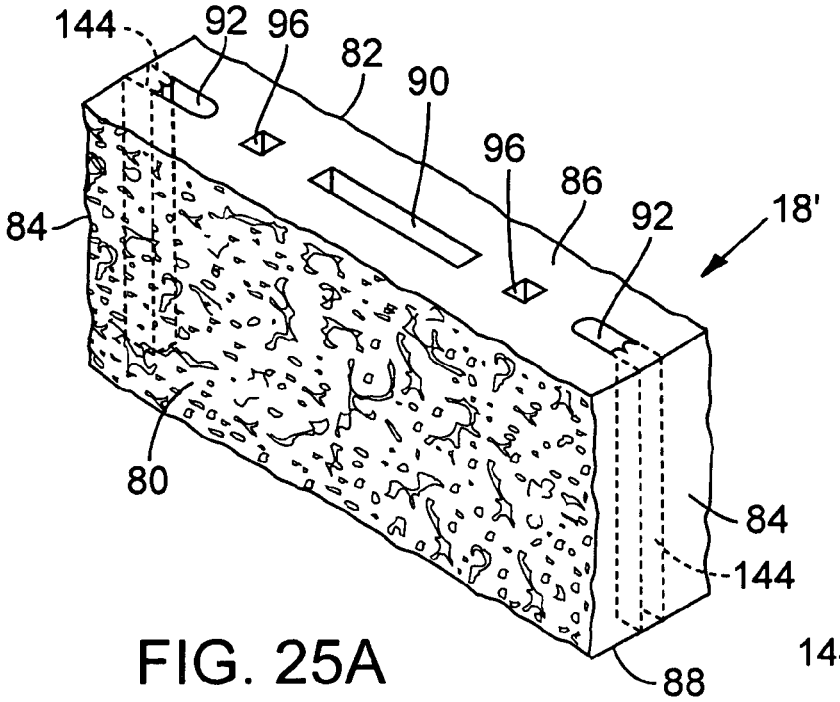
FIG. 25A is a perspective view of a panel block, according to another embodiment, used to form panels in a wall.
Figure 25B:
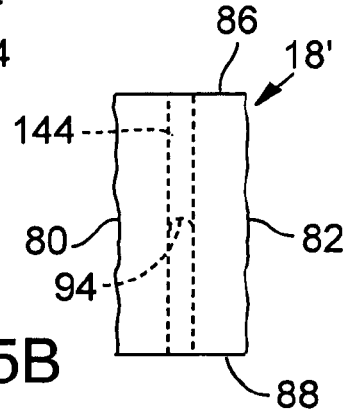
FIG. 25B is an end elevational view of the panel block shown in FIG. 25A.
Figure 25C:
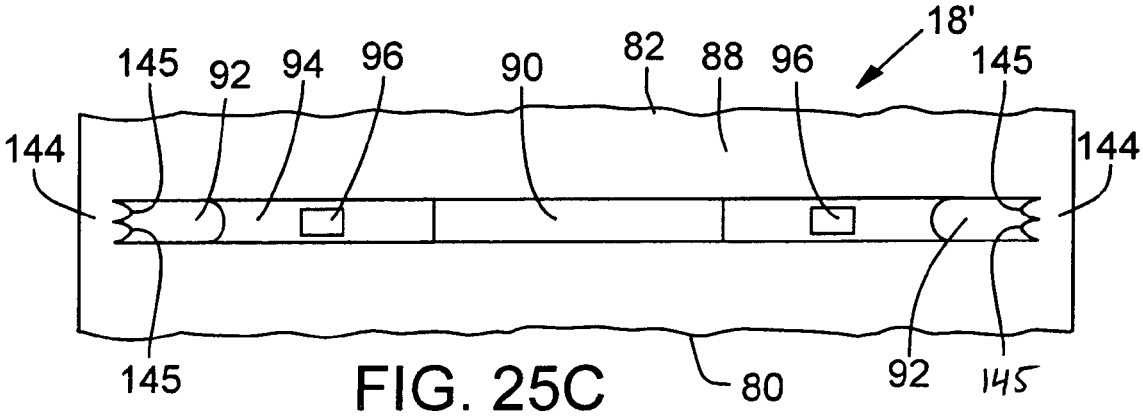
FIG. 25C is a bottom plan view of the panel block shown in FIG. 25A.

In particular embodiments, the top of the slot 94 is approximately midway between the upper and lower surfaces 86, 88, respectively, as depicted in panel block 18' shown in FIGS. 25A-25C. Thus, when a course of panel blocks is reinforced with a horizontal reinforcing member 100, the reinforcing member can be positioned at about the middle of the height of the course to balance the compressive load of the reinforcing member between the upper and lower surfaces of the panel blocks in the course. Placing the reinforcing member 100 at this location maximizes the retention capability of the reinforcing member.

Due to the slot 94 having a greater height in the block, portions of the block can be susceptible to breakage during shipment or handling of the block. To minimize such breakage, the panel block 18' can include sacrificial portions 144 (also referred to as "knock-out" portions) (shown in dashed lines in FIGS. 25A and 25B) where openings 92 would normally intersect sides 84 of the block. The inner surfaces of the sacrificial portions 144 can be formed with notches 145 extending the height of the block to facilitate removal of the sacrificial portions 144. The sacrificial portions 144 interconnect the concrete portions separated by openings 92 and therefore minimize chipping or breakage of the concrete at the ends of the block. Prior to installation, sacrificial portions 144 are removed to extend openings 92 to the sides 84 of the block.

Figure 13:
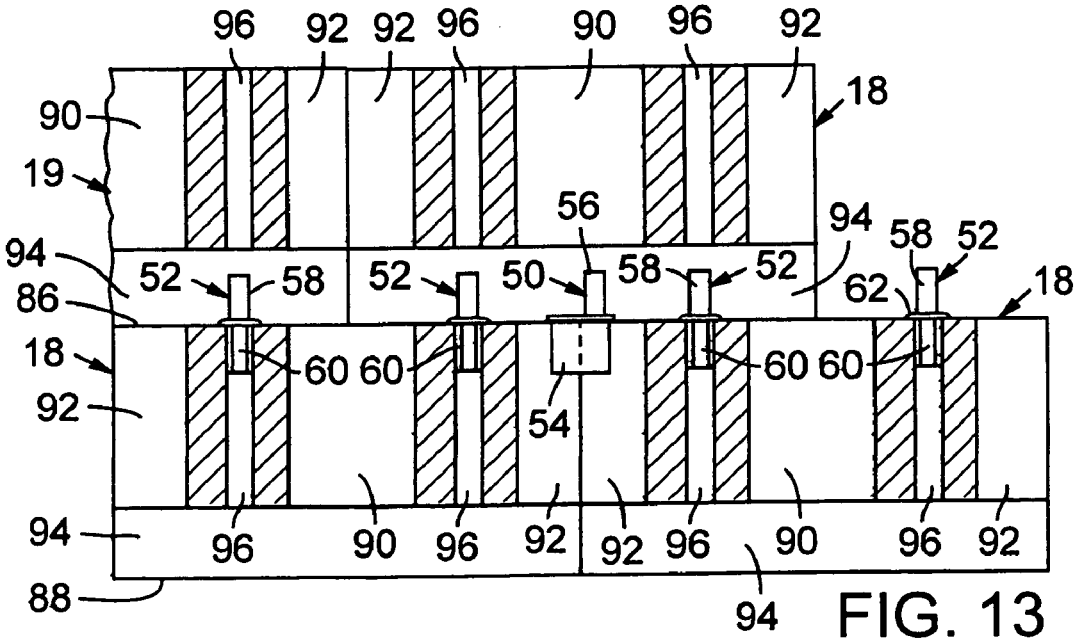
FIG. 13 is a fragmentary, cross-sectional view of a panel illustrating the use of the block-connecting elements of FIGS. 10 and 11 to interconnect vertically adjacent block in the construction of the panel.

As best shown in FIGS. 1 and 13, the panel blocks 18 are stacked in courses so as to form a "running bond"; that is, the panel blocks 18 are placed in a staggered manner such that each panel block 18 straddles two panel blocks in a lower course, except where a half block 19 is used at the ends of a course. Half blocks 19 can be formed, for example, by splitting panel blocks 18 in half or by separately molding blocks that are ½ the length of the panel blocks 18.

When forming the courses of panel blocks 18, either alignment plugs 50 (FIG. 10) or alignment pins 52 (FIG. 11) can be used to interconnect vertically adjacent blocks. FIG. 13 illustrates the use of both block-connecting elements 50 and 52, although one or the other type of connector can be used; it is not required or necessary to use both types of block-connecting elements when constructing a panel 12.

As shown in FIG. 13, if block-connecting elements 52 are used, the lower portions 60 of the block-connecting elements are inserted into the openings 96 of the blocks in a lower course. The upper portions 58 of the block-connecting elements 52 are inserted upwardly into corresponding slots 94 of overlying blocks as they are placed over the blocks in the previously formed course. Typically, a block-connecting element 52 is inserted into each opening 96 of a block as a course is formed so that each block will be connected to two blocks in an overlying course in the staggered manner shown in FIG. 13.

When constructing a panel using block-connecting elements 50, the lower portion 54 is inserted into the void formed by the openings 92 of two abutting blocks in the same course. The upper portion 56 of the block-connecting element is inserted upwardly into a slot 94 of an overlying block as it is placed over the two lower blocks in the staggered manner shown in FIG. 13. Alternatively, the blocks in vertically adjacent courses can be interconnected by placing the lower portions 54 of block-connecting elements 50 in the central openings 90 of the blocks in the lower course rather than in the voids formed by openings 92.

Selected one or more courses of a panel 12 can be reinforced using a post-tensioned horizontal reinforcing member 100. In particular embodiments, as shown in FIG. 1, the lowermost course and uppermost course of blocks in each panel 12 are reinforced with a post-tensioned horizontal reinforcing member 100 extending through the slots 94 of the panel blocks 18 in those courses. However, depending on the height of the wall structure and the anticipated loads on the wall structure, additional courses (e.g., every course, every other course or every third course) can be reinforced with a horizontal reinforcing member 100. The reinforcing members 100 typically are steel rods or bars, but can be any elongated member that can be placed in tension to reinforce the courses of panel blocks 18. In certain embodiments, for example, the reinforcing members 100 comprise steel rods having a diameter of 0.50", 0.625", or 0.75", although smaller or larger diameter rods also can be used.

Figure 5:
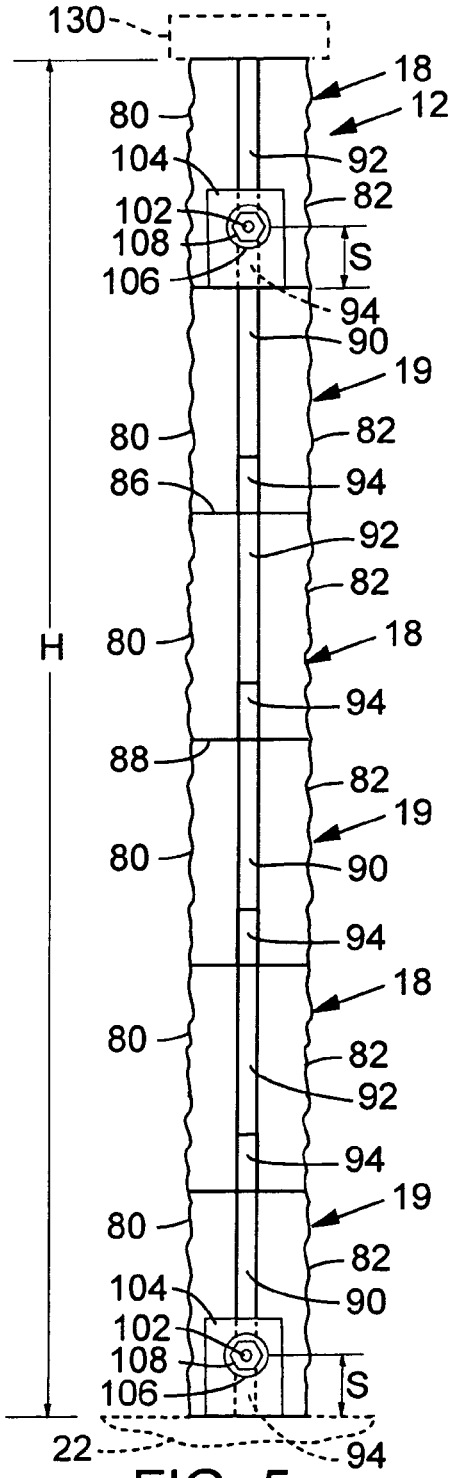
FIG. 5 is an end view of a reinforced panel of the wall shown in FIG. 1 formed from a plurality of panel blocks.

As best shown in FIGS. 3 and 5, the opposite end portions 102 of each reinforcing member 100 have threaded outer surfaces and extend through respective rigid plates 104 and washers 106 at the ends of the panel 12. Nuts 108 are tightened onto the end portions 102 to tension the reinforcing member, which applies a compressive force to the panel blocks in the course, thereby reinforcing that course of blocks. Desirably, a gasket material (e.g., latex cement) is applied to the end surfaces of the blocks at the ends of the course adjacent the rigid plates 104 prior to post-tensioning the reinforcing member so that the plates bear against the gasket material. When the first or lowermost course in each panel 12 is reinforced with a reinforcing member 100, the lowermost course serves as a "rail" or "ledger" for supporting successive courses. Advantageously, a continuous concrete footing extending between the pilasters 14, 16 is not required to support the panels 12, as in conventional free-standing block walls. The elimination of a continuous footing represents a substantial reduction in material and labor costs for constructing the wall structure. The reinforced courses can be constructed in the field as the wall structure is being built. Alternatively, reinforced courses with a post-tensioned reinforcing member 100 can be pre-assembled and shipped to the job site, thereby reducing labor costs and facilitating installation.

Depending on the size of the panels 12 used, each panel 12 may be further reinforced using one or more post-tensioned vertical reinforcing members 120 extending the height of the panel (one such reinforcing member is used in the full panel shown in FIG. 1). The reinforcing member 120 extends vertically through the cores 90 of the panel blocks 18 and the voids formed by half-cores 92 of abutting panel blocks 18. The reinforcing member 120 has a threaded upper end portion extending above the top course of panel blocks and a threaded lower end portion extending below the bottom course of panel blocks. A rigid plate 122, a washer 124, and a nut 126 are disposed on each of the upper and lower portions of the reinforcing member 120. The nuts 126 are tightened to tension the reinforcing member 120 and apply a compressive force to the panel between the plates 122.

In applications where greater reinforcement of the panels is required, such as in high wind applications (e.g., 120 mph wind or greater), the lower ends of reinforcing members 120 can be secured to respective concrete footings (not shown) in the ground. In this manner, tensioning the reinforcing members 120 compresses that panels downwardly against the footings to better resist lateral forces (e.g., wind) applied to the panels. The footings used for this purpose can be the same as footings 22 used to support the pilasters. The same techniques can be used to secure reinforcing members 120 to the footings as described above for securing reinforcing members 24 to footings 22. In an alternative embodiment, the footings can be conventional truncated pyramidal pier blocks, such as commonly used in the construction of wood decks. In this alternative embodiment, the reinforcing members 120 can be sized to extend completely through the pier blocks with nuts tightened onto the lower end portions of the reinforcing members below the pier blocks.

Figure 26A:
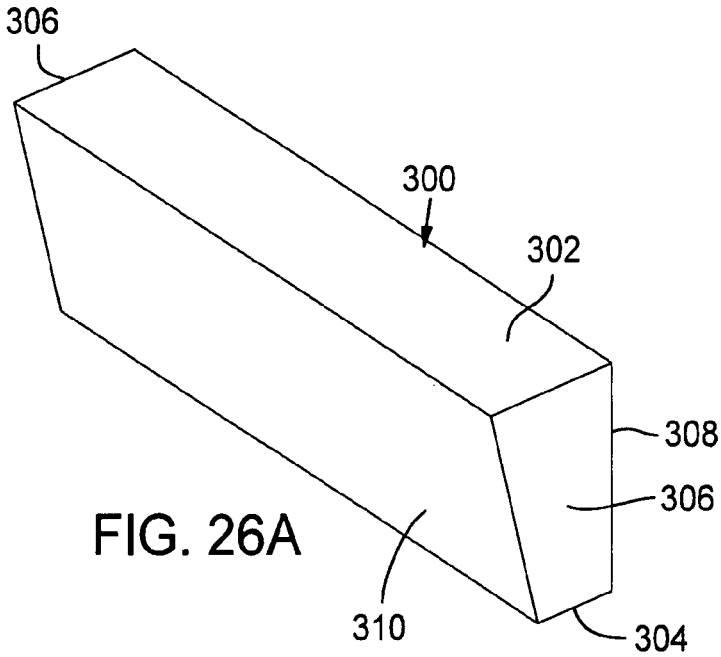
FIG. 26A is a perspective view of a capping block, according to one embodiment.
Figure 26B:
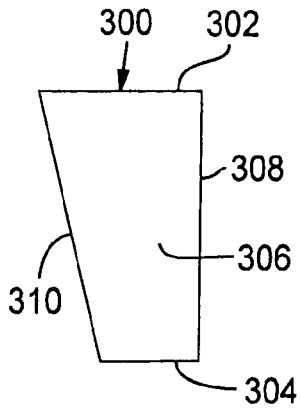
FIG. 26B is an end elevational view of the capping block shown in FIG. 26A.

FIGS. 26A and 26B show a capping block 300, according to another embodiment, that can be used form a capping layer, or course, on top of a pilaster. The capping block 300 has a trapezoidal cross-section (as best shown in FIG. 26B) with parallel upper and lower surfaces 302 and 304, respectively, opposing and parallel end surfaces 306, and first and second side surfaces 308 and 310, respectively, extending between respective ends of the upper and lower surfaces 302, 304. The first side surface 308 extends perpendicular to the upper and lower surfaces, while the second side surface 310 extends at an acute angle with respect to the upper surface 302 such that the block tapers from the upper surface to the lower surface.

Figure 27:
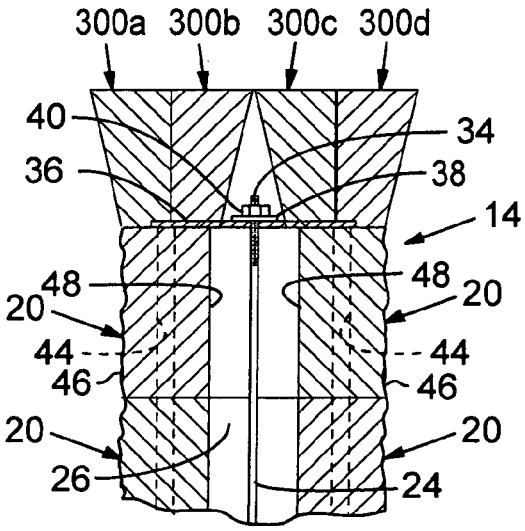
FIG. 27 is a fragmentary, cross-sectional view of a pilaster having a capping layer constructed from four capping blocks, according to one embodiment.
Figure 28:
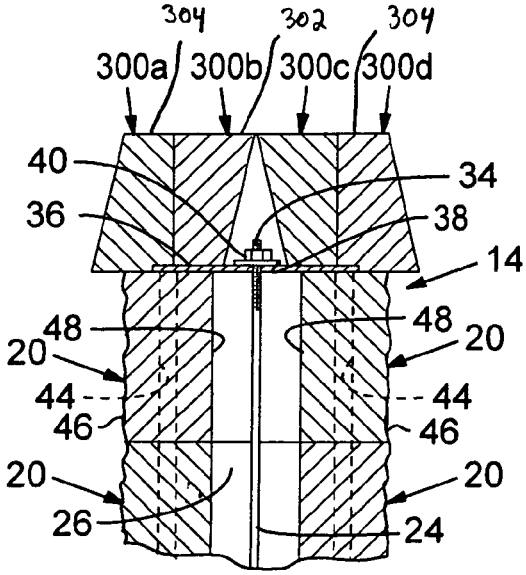
FIG. 28 is a fragmentary, cross-sectional view of a pilaster having a capping layer constructed from four capping blocks, according to another embodiment.

FIG. 27 shows a capping layer formed from four capping blocks 300*a*, 300*b*, 300*c*, 300*d* arranged side-by-side on top of a pilaster 14. The inner capping blocks 300*b*, 300*c* are arranged to form a triangular void that receives the upper end of the reinforcing rod 24 and the washer 38 and nut 40 mounted thereon. The outer capping blocks 300*a*, 300*d* are positioned with their perpendicular sides 308 abutting the perpendicular sides 308 of the inner capping blocks 300*c*, 300*d* so as to form a capping layer that tapers from top to bottom. FIG. 28 shows an alternative configuration of a capping layer constructed from four capping blocks 300*a*, 300*b*, 300*c*, 300*d*. In the capping layer of FIG. 28, the outer capping blocks 300*a*, 300*d* are positioned upside down with their respective surfaces 304 forming the upper surface of the capping layer so that the capping layer tapers from bottom to top.

The block wall system described herein provides a durable and secure free-standing wall system that can be economically installed without skilled labor and with substantial reductions in material costs and labor costs over conventional free-standing block wall systems. Notably, grout is not required to attach any of the horizontal or vertical reinforcing members to the pilaster blocks or to the panel blocks, nor is mortar required in forming each course of pilaster and panel blocks. The elimination of grout and mortar greatly simplifies the construction process while eliminating the need for a mason or other skilled worker to construct the wall. Moreover, the elimination of a continuous footing along the fence line reduces material costs and labor expenses. The resulting block wall structure will be less expensive while providing the necessary system strength and integrity.

In addition, the pilasters advantageously support the panels 12 without any mechanical fasteners directly securing or attaching the panels to the pilasters. This arrangement allows the panels to "float" or move slightly within the spaces between the stacks of pilaster blocks to provide a greater degree of stability. Such movement can be caused by, for example, thermal expansion or contraction, seismic forces, or uneven settlement of the soil along the length of the wall structure.

The pilaster arrangement further simplifies wall construction due to the existence of a large degree of dimensional forgiveness between the pilasters and the panels. Explaining further, the panels are maintained in their upright positions by virtue of the panel end portions being positioned between stacks of the laterally spaced-apart pilaster blocks without mechanical fasteners securing the end portions to the pilasters. The void in each pilaster that receives the adjacent end portions of two panels is large enough to accommodate variations in the length of a panel or the spacing between the pilasters that may occur during the construction of the wall. In effect, a high degree of precision with regard to pilaster spacing or panel size is not required in the construction of a wall, as is required in prior systems.

In an exemplary implementation of the illustrated embodiment, the panel block 18 has a height of about 8 inches, a length extending between the sides 84 of about 18 inches, and a width extending between the first and second faces 80, 82 of about 4-6 inches, with a width of about 5 inches being a specific example. The pilaster block 20 has a height of about 8 inches, a length of about 16 inches, and a width extending between the first and second faces 46, 48 of about 4-6 inches, with a width of about 5 inches being a specific example. Of course, these specific dimensions (as well as other dimensions provided in the present specification) are given to illustrate the invention and not to limit it. The dimensions provided herein can be modified as needed in different applications or situations.

Although less desirable, in alternative embodiments, grout can be used to secure the horizontal and/or vertical reinforcing members to the blocks of the wall. For example, grout can be used to secure horizontal reinforcing members 100 to the panel blocks 18. When grout is used to secure a reinforcing member, post tensioning techniques need not be applied to the reinforcing member; that is, the reinforcing member can be a conventional steel rod that is not placed in tension. Additionally, if desired for a particular application, conventional mortared joints can be used in the construction of the pilasters and/or the panels.

While the illustrated blocks 18, 19, 20, 68, 72 have pin holes or openings for accommodating connecting pins or plugs, other techniques or mechanisms can be used to interconnect vertical adjacent blocks. In one implementation, for example, a suitable adhesive can be applied between successive courses in the panels 12. In another implementation, the panel blocks can have an interlocking tongue-and-groove configuration. In another implementation, vertical reinforcing members can be extended through panel blocks in each course of a panel and post-tensioned to compress the blocks in the vertical direction.

Figure 22:
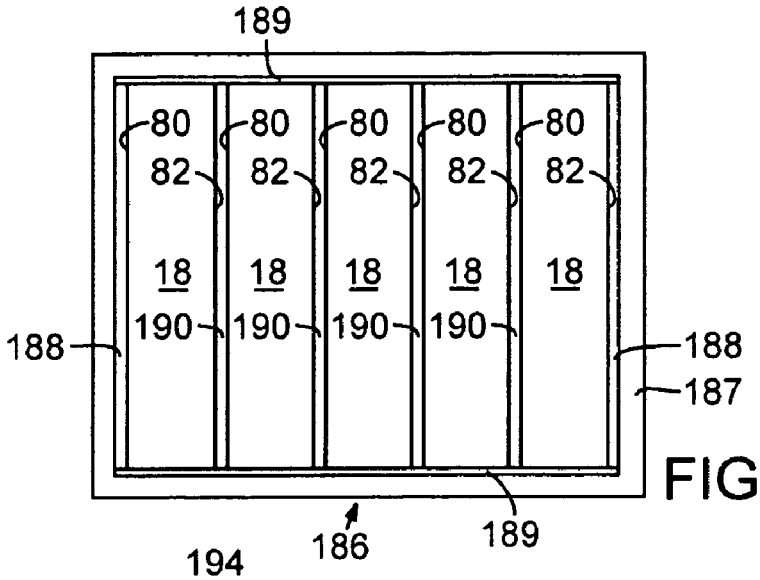
FIG. 22 is a schematic, top plan view of an exemplary mold layout for forming multiple panel blocks.

FIG. 22 shows an exemplary mold assembly 186 for forming five 4"×18" panel blocks 18. The mold includes an outer frame 187 surrounding end plates 188, side plates 189 and separating plates 190 separating the blocks 18 in the mold. The inner surfaces of end plates 188 and both side surfaces of plates 190 contacting the blocks 18 can have projections (not shown), which form a roughened surface texture on the front and back surfaces 80, 82 of the blocks 18 as the blocks are removed from the mold, as described in U.S. Patent Application Publication No. 2003-0164574. The mold can be modified as desired to accommodate greater or fewer number of blocks or larger or smaller blocks.

Figure 23:
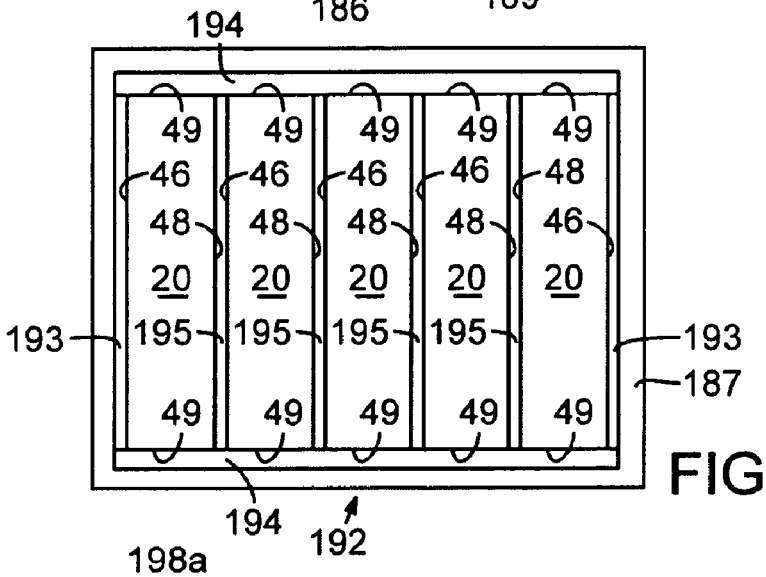
FIG. 23 is a schematic, top plan view of an exemplary mold layout for forming multiple pilaster blocks.

FIG. 23 shows an exemplary mold assembly 192 for forming five 4"×16" pilaster blocks 20. The mold includes an outer frame 187 surrounding end plates 193, side plates 194, and separating plates 195 separating the blocks 20 in the mold. The inner surfaces of end plates 193 and side plates 194 and the side surfaces of separating plates 195 contacting the front surfaces 46 of the blocks can have texture-forming projections for forming roughened surface textures on the front surfaces 46 and the end surfaces 49 of the blocks. The mold can be modified as desired to accommodate greater or fewer number of blocks or larger or smaller blocks.

In the disclosed embodiment, the panel blocks 18 and the pilaster blocks 20 have the same overall rectangular shape and similar dimensions, which allows the molds for forming the panel blocks and the pilaster blocks to be easily modified for forming either type of block, thereby reducing manufacturing costs. For example, a mold assembly 192 for forming the pilaster blocks 20 can be easily assembled by using the outer frame 187 from a mold assembly 186 and replacing the end plates, side plates and the separating plates from mold assembly 186 with those required for mold assembly 192. This obviates the need for two separate mold assemblies for forming the panel blocks and the pilaster blocks.

Figure 24:
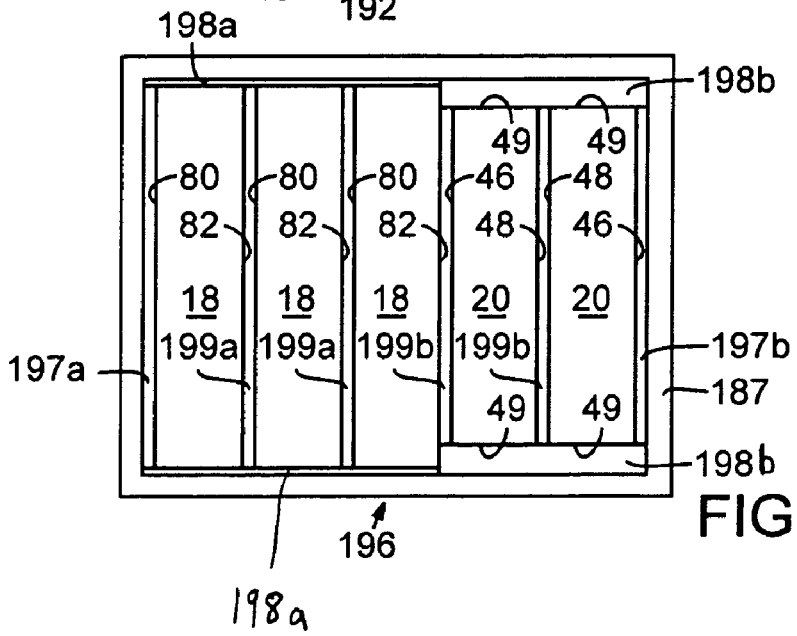
FIG. 24 is a schematic, top plan view of an exemplary mold layout for forming pilaster blocks and panel blocks.

Additionally, multiple panel blocks and pilaster blocks can be formed simultaneously in the same mold. For example, FIG. 24 shows an exemplary mold assembly 196 for forming three 4"×18" panel blocks 18 and two 4"×16" pilaster blocks 20, although the mold can be modified as desired for forming a different combination of such blocks. The mold assembly includes an outer frame 187 surrounding end plates 197*a*, 197*b*, side plates 198*a* adjacent the ends of the panel blocks 18, side plates 198*b* adjacent the end surfaces 49 of the pilaster blocks 20, and separating plates 199*a* and 199*b* separating the panel blocks 18 and the pilaster blocks 20. Texture-forming projections can be provided on the inner surfaces of end plates 197*a*, 197*b* and side plates 198*b*, both side surfaces of separating plates 199*a*, and the side surface of the inner most separating wall 199*b* contacting the front surface 46 of the adjacent pilaster block 20 so as to form roughened surface textures on the front and back surfaces 80, 82 of the panel blocks 18, and the front surfaces 46 and the end surfaces 49 of the pilaster blocks 20.

An exemplary method for constructing a free-standing wall is as follows. First, the formwork for the concrete footings 22 are formed at predetermined locations along the fence line using suitable techniques. Re-bar 42, plates 112 and rods 28 are placed in the formwork and thereafter concrete is introduced into the formwork using suitable techniques to form the footings 22. After a suitable curing time, vertical reinforcing members 24 are tightened into the threaded coupling members 30.

The first course of each panel 12 is formed by laying horizontal reinforcing members 100 along the fence line between adjacent footings and placing a row of panel blocks 18 over the reinforcing members 100. Alternatively, the panel blocks 18 are positioned along the fence line and the horizontal reinforcing members are subsequently inserted or "threaded" through the slots 94 of the panel blocks. In either case, rigid plates 104, washers 106 and nuts 108 are placed on the ends of the reinforcing members 100, which are then tensioned as needed.

Successive courses of panel blocks 18 are formed over the first, post-tensioned course in each panel 12. Alignment pins 52 and/or plugs 50 can be used to connect vertically adjacent blocks, as described above. The uppermost course in each panel 12 is constructed by laying a horizontal reinforcing member 100 on the previously installed course, laying panel blocks 18 over the reinforcing member, and tensioning the reinforcing member. Selected courses between the lowermost and uppermost course in each panel 12 also can be reinforced depending on the wall height and/or the anticipated loads on the wall.

The pilasters 14, 16 are formed by stacking the appropriate pilaster blocks on the footings 22 in the manner described above. After the stacks of blocks are formed, a plate 36, a washer 38, and a nut 40 are placed on the upper end portion of each vertical reinforcing member 24. The nuts 40 are tightened as needed to tension the reinforcing members 24. Thereafter, capping blocks 128 can be placed over the pilasters 14, 16 and courses of capping blocks 130 can be formed on top of the panels 12 to finish the wall.

Figures 16, 17, 18:
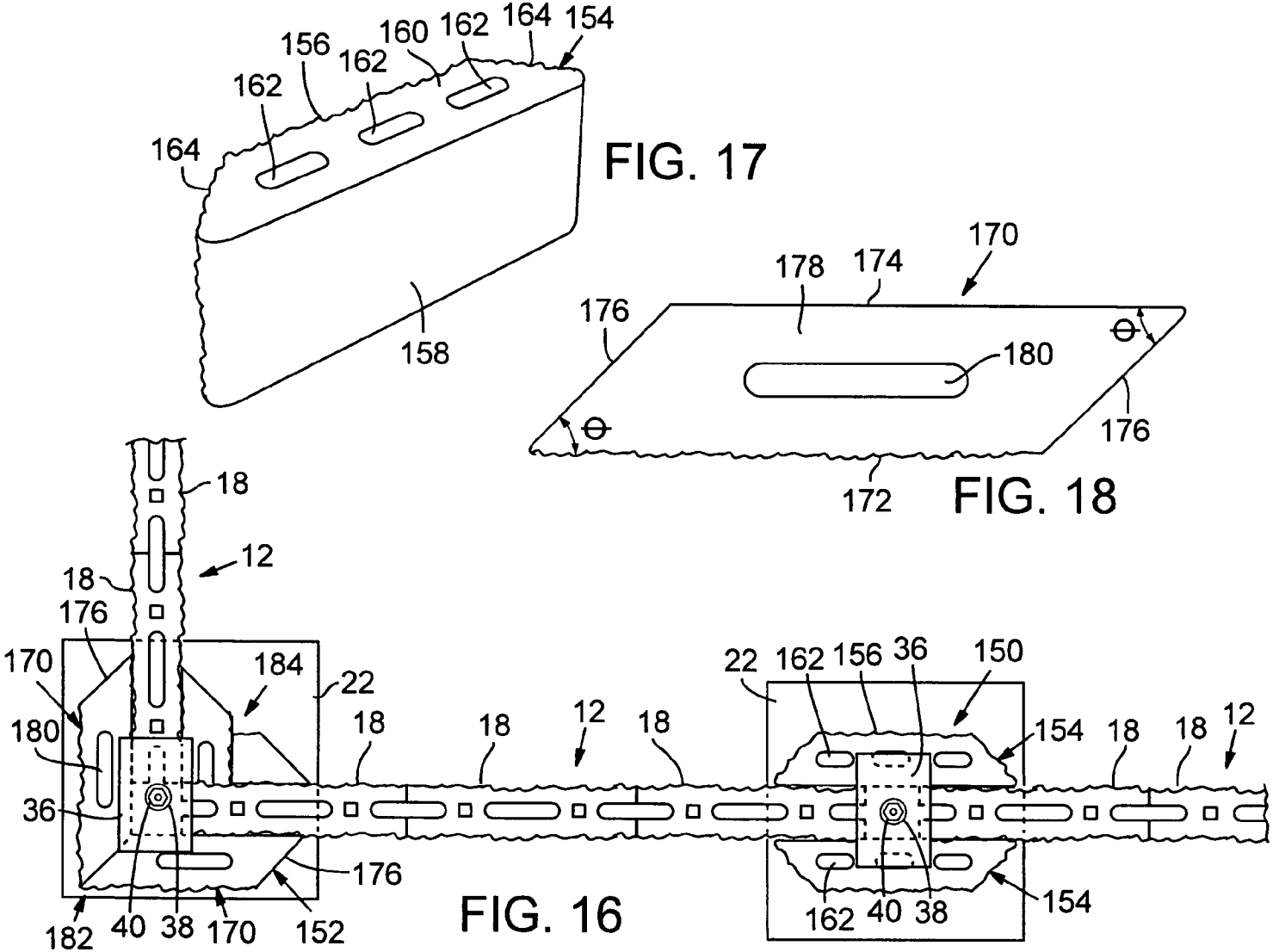
FIG. 16 is a top plan view of a free-standing wall constructed from a plurality of masonry blocks, according to another embodiment.
FIG. 17 is a perspective view of a pilaster block used to form the field pilasters in the wall shown in FIG. 15.
FIG. 18 is a top plan view of a pilaster block used to form the corner pilasters in the wall shown in FIG. 15.

FIG. 16 is a top plan view of another embodiment of a masonry block wall. The wall in this embodiment includes a plurality of panels 12, a field pilaster 150, and a corner pilaster 152. Panels 12 are formed from courses of panel blocks 18 as previously described. Field pilaster 150 is constructed in the same manner as described above for pilaster 14 (FIGS. 1-3), except that a plurality of trapezoidal pilaster blocks 154, rather than the rectangular pilaster blocks 20, are used for forming pilaster 14.

As best shown in FIG. 17, the pilaster block 154 comprises opposed, generally parallel first and second faces 156, 158, respectively, side surfaces 164 extending between respective ends of the first and second faces 156, 158, an upper surface 160 and a parallel lower surface. The first face 156 has a length (measured between the side surfaces 164) that is less than the length of the second face 158. The side surfaces 164 converge in a direction from the second face 158 to the first face 156, desirably at a 45 degree angle with respect to the second face 158. The illustrated pilaster block 154 also is formed with one or more openings 162 desirably extending the entire height of the block. The openings 162 are sized to receive a block-connecting element for connecting vertically adjacent blocks, such as an alignment pin 52 (FIG. 11) or an alignment plug 50 (FIG. 10).

Corner pilaster 152 is constructed from a plurality of pilaster blocks 170 (FIGS. 16 and 18). Pilaster block 170 in the illustrated configuration is generally in the shape of a parallelogram and comprises opposed, generally parallel first and second faces 172, 174, respectively, opposed, generally parallel side surfaces 176 extending between respective ends of the first and second faces 172, 174, an upper surface 178 and a parallel lower surface. In the illustrated embodiment, the angle θ between the side surfaces 176 and the first and second faces 172, 174 is about 45 degrees, although this angle could be greater or less than 45 degrees in other embodiments. Pilaster block 170 also is formed with at least one opening 180 desirably extending the entire height of the block. The opening 180 is sized to receive a block-connecting element for connecting vertically adjacent blocks, such as an alignment pin 52 (FIG. 11) or an alignment plug 50 (FIG. 10).

As shown in FIG. 16, the corner pilaster 152 comprises an outer portion 182 on one side of the wall structure and an inner portion 184 on the other side of the wall structure. The outer portion 182 is formed from two stacks of pilaster blocks 170 positioned to form a 90-degree corner on the outside of the wall structure and such that the blocks 170 partially overlap the end portions of two adjacent panels 12 oriented at a 90-degree angle with respect to each other. When stacking the pilaster blocks 170, either alignment pins 52 (FIG. 11) or alignment plugs 50 (FIG. 10) can be used, as described above in regards to stacking pilaster blocks 20.

The inner portion 184 can be formed by first splitting a plurality of pilaster blocks 170 and stacking the split block portions in the manner shown in FIG. 16 to close the void between the adjacent ends of the panels 12 on the inside of the wall structure. In lieu of splitting the pilaster blocks 170, the inner portion 184 can be constructed from smaller blocks having the shapes of the split block portions shown in FIG. 16 or from blocks having various other geometric shapes.

FIGS. 19-21 show a set of tables that can be used to determine certain design criteria for constructing a wall, according to one embodiment. The data provided in the tables shown in FIGS. 19-21 are for wall constructions using 5" (width)×18" (length)×8" (height) panel blocks 18 (referred to as "field" blocks in the tables) having a 1"×2½" center slot 90, and 5" (width)×16" (length)×8" (height) pilaster blocks 20. Table 200 of FIG. 19 is a wind pressure table used to determine the anticipated wind pressure on the wall to be built. Using table 200, the anticipated wind pressure for a wall is the value in table 200 corresponding to the wind speed and exposure level at the location where the wall is to be constructed. For example, if the location of a wall is subject to a wind speed of 100 mph and a "C" exposure level, the wall will be designed for a wind pressure of 16.64 psf (pounds per square foot).

After the wind pressure is determined, tables 202-212 of FIG. 20 and tables 214-222 of FIG. 21 can be used to determine the reinforcement requirements for a desired wall height and pilaster spacing. More specifically, tables 202, 204, 206 show design data for walls designed for a maximum wind pressure of 10.00 psf and a center-to-center pilaster spacing of 8.25 feet, 9.75 feet, and 11.25 feet, respectively; tables 208, 210, 212 show design data for walls designed for a maximum wind pressure of 13.33 psf and a center-to-center pilaster spacing of 8.25 feet, 9.75 feet, and 11.25 feet, respectively; tables 214, 216, 218 show design data for walls designed for a maximum wind pressure of 16.67 psf and a center-to-center pilaster spacing of 8.25 feet, 9.75 feet, and 11.25 feet, respectively; and tables 220, 222 show design data for walls designed for a maximum wind pressure of 20.00 psf and a center-to-center pilaster spacing of 8.25 feet and 9.75 feet, respectively.

Each table 202-222 specifies for a plurality of wall heights H (FIG. 5) the following design criteria for constructing a wall: the diameter of the upper and lower rods (reinforcement members 100), the minimum spacing S (FIG. 5) for the upper and lower horizontal rods (given in inches), the force of the horizontal rods, the diameter and force of the pilaster rod (reinforcing member 24) for a single-rod pilaster, the diameter and force of the pilaster rods for a double-rod pilaster, the pilaster and footing weight, the overturning moment, and the minimum width of a square footing (given in feet).

Additional tables can be provided for greater wind pressures and/or different fence spans than shown in FIGS. 20 and 21. Additionally, the data provided in tables 202-212 may vary for blocks having dimensions that are different from those specified.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A masonry block wall structure, comprising:

at least first and second footings formed in the ground and spaced along the wall structure;

first and second pilasters supported on the first and second footings, respectively, each pilaster comprising at least a first stack of pilaster blocks and at least a second stack of pilaster blocks positioned on opposite sides of the wall structure from each other;

at least one vertical post-tensioned reinforcing member extending upwardly through and reinforcing each pilaster; and at least one panel comprising a plurality of courses of panel blocks, the courses being without any mortar or grout between adjacent panel blocks, the panel having first and second end portions, the first end portion positioned between and abutting the first and second stacks of pilaster blocks of the first pilaster and the second end portion positioned between and abutting the first and second stacks of pilaster blocks of the second pilaster such that the panel is supported by and extends between the first and second pilasters;

wherein first and second pilasters are without any mortar or grout between the pilaster blocks forming the pilasters.

2. The wall structure of claim 1, wherein selected courses of the panel having a respective horizontal post-tensioned reinforcing member extending horizontally through the blocks of the selected courses.

3. The wall structure of claim 1, wherein:

the panel blocks have upper and lower surfaces that are formed with at least one opening therein; and the panel blocks in each course are connected to panel blocks in an overlying course of blocks by a plurality of block-connecting elements, each block-connecting element having a lower portion extending into a respective opening in the upper surface of a respective first panel block and an upper portion extending into a respective opening in the lower surface of a respective second panel block that is vertically adjacent to and contacts the first panel block.

4. The wall structure of claim 1, wherein there is no concrete footing below the majority of the length of the panel.

5. The wall structure of claim 1, wherein the vertical reinforcing members have lower end portions secured to the footings.

6. The wall structure of claim 1, wherein the panel includes at least one vertical post-tensioned reinforcing member extending upwardly through and reinforcing the panel.

7. The wall structure of claim 1, wherein the reinforcing members comprise rigid bars or rods.

8. The wall structure of claim 1, wherein the reinforcing members comprise cables.

9. The wall structure of claim 1, wherein the at least one reinforcing member of each pilaster extends vertically through a cavity defined between respective first and second stacks of pilaster blocks.

10. The wall structure of claim 1, wherein the at least one reinforcing member of each pilaster comprises first and second reinforcing members, the first reinforcing member extending vertically through a respective first stack of pilaster blocks and the second reinforcing member extending vertically through a respective second stack of pilaster blocks.

11. The wall structure of claim 10, wherein the first and second reinforcing members of each pilaster have threaded upper end portions extending upwardly through a rigid plate disposed on top of the respective first and second stack of pilaster blocks and a nut is tightened onto the threaded end portion of each reinforcing member, therefore causing the plate to apply a compression force to the stacks of pilasters blocks.

12. The wall structure of claim 1, wherein the at least one reinforcing member of each pilaster has a threaded upper end portion extending upwardly through a rigid plate disposed on top of the respective first and second stack of pilaster blocks and a nut is tightened onto the threaded end portion to tension the reinforcing member, therefore causing the plate to apply a compression force to the stacks of pilaster blocks.

13. A masonry block wall structure, comprising:

first and second pilasters located at spaced apart locations along the wall structure, each pilaster comprising a plurality of pilaster blocks; and at least one panel comprising a plurality of courses of panel blocks, the panel having first and second end portions, the first end portion being supported by the first pilaster and the second end portion being supported by the second pilaster such that the panel is supported by and extends between the first and second pilasters;

wherein a plurality of the panel blocks each comprises a top surface, a lower surface facing in a direction opposite the top surface, two opposing side surfaces, opposing first and second faces, an opening in the lower surface of the block, two half cores formed in the opposite side surfaces of the block and extending the height of the block, and a slot formed in the lower surface of the block, the slot being substantially equidistant from the first and second faces and extending the length of the block;

the panel blocks are placed side-by-side in the courses such that the half cores of two abutting side surfaces of adjacent blocks form a void between the adjacent blocks, the panel blocks of each course forming a running bond with respect to an underlying course such that the panel blocks are longitudinally offset from the panel blocks in an underlying course with the openings being vertically aligned with respective voids in the underlying course;

the panel blocks of at least one of said courses are connected to panel blocks in an underlying course of blocks by a plurality of block-connecting elements that are separate components from the panel blocks, each block-connecting element having an upper portion disposed in an opening in one of the panel blocks in the at least one of said courses and a lower portion disposed in one of said voids formed in the underlying course;

the panel is formed without any mortar or grout; and selected courses of the panel have a horizontal post-tensioned reinforcing member extending horizontally through the slots in the lower surfaces of the panel blocks of the selected courses, the horizontal post-tensioned reinforcing member of each selected course being substantially equidistant from the first and second faces of the panel blocks of the selected course.

14. The wall structure of claim 13, wherein the pilasters are formed without any mortar or grout.

15. A masonry block wall structure, comprising:

first and second pilasters located at spaced apart locations along the wall structure, each pilaster comprising a plurality of pilaster blocks; and at least one panel comprising a plurality of courses of panel blocks, the panel having first and second end portions, the first end portion being supported by the first pilaster and the second end portion being supported by the second pilaster such that the panel is supported by and extends between the first and second pilasters;

wherein:

a plurality of the panel blocks each comprises a top surface, a lower surface facing in a direction opposite the top surface, two opposing side surfaces, opposing first and second faces, an opening in the top surface of the block, two half cores formed in the opposite side surfaces of the block and extending the height of the block, and a slot formed in the lower surface of the block and extending the length of the block;

the panel blocks are placed side-by-side in the courses such that the half cores of two abutting side surfaces of adjacent blocks form a void between the adjacent blocks, the panel blocks of each course forming a running bond with respect to an underlying course such that the panel blocks are longitudinally offset from the panel blocks in an underlying course with the cores being vertically aligned with respective voids in the underlying course; and the panel blocks of at least one of said courses are connected to panel blocks in an underlying course of blocks by a plurality of block-connecting elements that are separate components from the panel blocks, each block-connecting element having an upper portion disposed in one of said voids formed in the at least one of said courses and a lower portion disposed in an opening of a panel block in the underlying course;

the panel is formed without any mortar or grout;

selected courses of the panel have a horizontal post-tensioned reinforcing member extending horizontally through the slots in the lower surfaces of the panel blocks of the selected courses, each horizontal post-tensioned reinforcing member extending the length of the panel and having first and second end portions terminating within the first and second pilasters, respectively, each end portion of the reinforcing member engaging a threaded nut that is tightened to place the reinforcing member in tension.

16. The wall structure of claim 13, further comprising at least one vertical post-tensioned reinforcing member extending upwardly through and reinforcing each pilaster, wherein the at least one reinforcing member of each pilaster extends upwardly through a rigid plate at the top of each pilaster and has a nut tightened onto the upper end portion thereof causing the plate to bear against the top of the pilaster.

17. The wall structure of claim 13, wherein the lowermost and uppermost courses of panel blocks each includes a horizontal post-tensioned reinforcing member extending horizontally through the panel blocks of the lowermost and uppermost courses, the horizontal post-tensioned reinforcing member of the lowermost course extending horizontally through the openings in the bottom surfaces of the panel blocks in the lowermost course, and the horizontal post-tensioned reinforcing member of the uppermost course extending horizontally through the openings in the bottom surfaces of the panel blocks in the uppermost course.

18. The wall structure of claim 13, further comprising at least first and second footings formed in the ground at spaced-apart locations, the first and second pilasters being formed on top of the first and second footings, respectively.

19. A method for forming a masonry block wall structure, the method comprising:

providing a panel comprising at least a first lower course of a plurality of panel blocks and at least a second upper course of a plurality of panel blocks overlying the first course, the panels blocks having opposing top and bottom surfaces facing in opposite directions, opposing side surfaces facing in opposite directions, opposing first and second faces facing in opposite directions, an opening in the bottom surface of the block and two half cores formed in the side surfaces of the block, the panel blocks being placed side-by-side in the courses such that the half cores of two abutting side surfaces of adjacent blocks form a void between the adjacent blocks, the panel blocks of each course forming a running bond with respect to an underlying course such that the panel blocks are longitudinally offset from the panel blocks in an underlying course with the openings being vertically aligned with respective voids in the underlying course, the panel blocks of the first course being connected to panel blocks in the second course by a plurality of block-connecting elements that are separate components from the panel blocks, each block-connecting element having an upper portion disposed in an opening in one of the panel blocks in the second course and a lower portion disposed in one of said voids formed by adjacent panel blocks in the first course, at least one course being reinforced with a post-tensioned reinforcing member that extends horizontally through the openings in the bottom surfaces of the blocks of the reinforced course at a location substantially equidistant from the first and second faces of the blocks of the reinforced course.

20. The method of claim 19, wherein the panel is formed without any mortar or grout.

21. The method of claim 19, further comprising:

forming first and second spaced apart pilasters for supporting the panel in an upright position extending between the pilasters.

22. A masonry block wall structure, comprising:

at least first and second footings formed in the ground at spaced-apart locations along the length of the wall structure;

first and second pilasters supported on the first and second footings, respectively, each pilaster comprising a plurality of pilaster blocks;

at least one panel comprising a plurality of courses of panel blocks, the courses being without any mortar or grout between adjacent panel blocks, the panel having first and second vertical end portions, the first end portion being supported by the first pilaster and the second end portion being supported by the second pilaster such that the panel is supported by and extends between the first and second pilasters, wherein the first and second footings are discrete footings that do not extend below the majority of the length of the panel, wherein the plurality of courses of the panel includes a lowermost course having first and second portions supported directly on the first and second footings, respectively;

wherein selected courses of the panel have a respective horizontal post-tensioned reinforcing member extending horizontally through the blocks of the selected courses, wherein one of the selected courses is the lowermost course of the panel, each horizontal post-tensioned reinforcing member extending the length of the panel and having first and second end portions terminating within the first and second pilasters, respectively, each end portion of the reinforcing member engaging a threaded nut that is tightened to place the reinforcing member in tension;

the panel blocks have upper and lower surfaces that are formed with at least one opening therein, the upper and lower surfaces facing in opposite directions, wherein the horizontal post-tensioned reinforcing members extend through the openings in the lower surfaces of the blocks in the selected courses;

the panel includes at least one vertical post-tensioned reinforcing member extending upwardly through blocks in each course of the panel to reinforce the panel; and the panel blocks in at least one course are connected to panel blocks in an overlying course of blocks by a plurality of block-connecting elements that are separate components from the panel blocks, each block-connecting element having a lower portion extending into a respective opening in the upper surface of a panel block and an upper portion extending into a respective opening in a vertically adjacent panel block.

* * * * *